US010201762B2

(12) United States Patent
Sutton

(10) Patent No.: US 10,201,762 B2
(45) **Date of Patent: *Feb. 12, 2019**

(54) TRANSFORMABLE TOY WITH REVERSIBLE HEAD AND INTEGRATED BOOK

(71) Applicant: Jay At Play International Hong Kong Limited, Kowloon (HK)

(72) Inventor: Joseph A. Sutton, Delray Beach, FL (US)

(73) Assignee: JAY AT PLAY INTERNATIONAL HONG KONG LIMITED, Kowloon (HK)

( * ) Notice: Subject to any disclaimer, the term of this patent is extended or adjusted under 35 U.S.C. 154(b) by 0 days.

This patent is subject to a terminal disclaimer.

(21) Appl. No.: 15/820,805

(22) Filed: Nov. 22, 2017

(65) Prior Publication Data

US 2018/0311591 A1 Nov. 1, 2018

Related U.S. Application Data

(63) Continuation-in-part of application No. 15/582,044, filed on Apr. 28, 2017, now Pat. No. 9,975,053.

(51) Int. Cl.
*A63H 33/38* (2006.01)
*A63H 3/12* (2006.01)
(Continued)

(52) U.S. Cl.
CPC ..... *A63H 3/12* (2013.01); *A63H 3/02* (2013.01); *A63H 3/365* (2013.01); *A63H 33/38* (2013.01)

(58) Field of Classification Search
CPC ..... A63H 33/38; A63H 3/12
See application file for complete search history.

(56) References Cited

U.S. PATENT DOCUMENTS 784,477 A * 3/1905 Dean ..... B42D 1/004 281/15.1
1,396,766 A 11/1921 McClelland
(Continued)

FOREIGN PATENT DOCUMENTS

AU 2013202294 3/2014
CA 1223735 7/1987
(Continued)

OTHER PUBLICATIONS

Bilboquet, "Lilliputiens—Snow White Reversible Puppet," Bilboquet.com, Available online as early as Mar. 15, 2017 (https://www.bilboquet.com/snow-white-reversible-puppet-lilliputiens,rsnow-white,,p19567.html).
(Continued)

*Primary Examiner* — Gene Kim
*Assistant Examiner* — Alyssa Hylinski
(74) *Attorney, Agent, or Firm* — Michael Best & Friedrich LLP

(57) ABSTRACT

A toy includes a body having a first side representative of a first body appearance, and a second side opposite the first side and representative of a second body appearance different from the first body appearance. The toy also includes a head coupled to the body, the head being reversible between a first face and a second face, the first face corresponding to the first body appearance and the second face corresponding to the second body appearance. When the first face of the head is exposed to view, the second face of the head is concealed from view inside the head, and when the second face of the head is exposed to view, the first face of the head is concealed from view inside the head. The toy further includes a book coupled to the second side of the body.

17 Claims, 37 Drawing Sheets

(51) Int. Cl.
*A63H 3/36* (2006.01)
*A63H 3/02* (2006.01)

(56) References Cited

U.S. PATENT DOCUMENTS 1,425,974 A 8/1922 Kearney
1,690,778 A 11/1928 Ford
2,195,127 A * 3/1940 Brucker ..... A63H 3/12 446/321
3,811,220 A 5/1974 Glass et al.
3,851,419 A * 12/1974 Kaelin ..... A63H 3/12 446/321
3,864,871 A * 2/1975 Kaelin ..... A63H 3/14 446/327
4,107,873 A 8/1978 Bauer
4,280,241 A 7/1981 Pfaff
4,336,665 A 6/1982 Moreau
4,413,442 A 11/1983 McSweeney
4,590,633 A 5/1986 Pickens
4,614,505 A 9/1986 Schneider et al.
4,639,233 A 1/1987 Brassfield
4,695,264 A 9/1987 McLeod, Jr.
4,734,075 A 3/1988 Park
4,739,529 A 4/1988 Mills
4,763,369 A 8/1988 Spector
4,781,648 A 11/1988 Garfinkel
4,832,648 A * 5/1989 Theobald ..... A63H 3/003 281/29
4,842,565 A 6/1989 VonPhilp, Sr.
4,853,994 A 8/1989 Ekstein
4,856,131 A * 8/1989 Mills ..... A63H 3/003 5/413 R
4,874,340 A 10/1989 Smallwood
4,880,404 A 11/1989 Derby, III
4,921,459 A 5/1990 Cook et al.
4,980,929 A 1/1991 Long
5,046,986 A 9/1991 Wood et al.
5,059,149 A 10/1991 Stone
5,090,938 A 2/1992 Reynolds
5,115,528 A 5/1992 Lamle
5,178,574 A 1/1993 Evoy
5,389,028 A * 2/1995 Cabrera ..... A47G 33/00 446/327
5,472,364 A * 12/1995 Castleman ..... A63H 33/004 281/29
5,649,848 A 7/1997 Clark
5,746,637 A 5/1998 Hunt
5,765,245 A * 6/1998 Breto ..... A47G 9/10 5/636
5,951,355 A 9/1999 Dana et al.
6,126,507 A 10/2000 Lieberman
D445,623 S 7/2001 Härtner
6,254,450 B1 * 7/2001 Schonberger ..... A63H 3/003 434/156
6,261,149 B1 7/2001 Moore
6,343,968 B1 2/2002 Louie et al.
6,364,360 B1 4/2002 Kaufman
6,390,507 B1 5/2002 Derraugh et al.
6,514,118 B1 2/2003 Bart et al.
6,712,396 B2 3/2004 Derraugh
6,899,387 B2 5/2005 Ariizumi
6,962,517 B2 11/2005 Murray
7,257,851 B1 8/2007 Nakamura
7,414,010 B2 8/2008 Burrows
7,621,795 B2 11/2009 Drescher
D660,069 S 5/2012 Beuerle
D670,123 S 11/2012 Beuerle
8,321,978 B1 12/2012 Fulton
8,444,451 B2 * 5/2013 Zhang ..... A63H 3/14 446/268
8,672,724 B2 3/2014 Beuerle
8,903,303 B1 12/2014 Garavito
9,975,053 B1 * 5/2018 Sutton ..... A63H 3/12
2002/0197930 A1 12/2002 Derraugh et al.
2004/0181844 A1 9/2004 Kim
2005/0110309 A1 5/2005 Cziraky et al.
2006/0001256 A1 1/2006 Morgan
2006/0066093 A1 3/2006 Healton et al.
2006/0084353 A1 4/2006 Wong et al.
2006/0084355 A1 4/2006 Wong et al.
2007/0028383 A1 2/2007 Mehrotra
2007/0174969 A1 8/2007 Nakamura
2008/0182478 A1 7/2008 Smoot et al.
2008/0211222 A1 9/2008 Nakamura
2008/0242187 A1 10/2008 Smith et al.
2009/0056727 A1 * 3/2009 Hill ..... A41D 11/00 128/880
2010/0035509 A1 2/2010 Lei
2012/0108141 A1 5/2012 Zhang
2012/0276802 A1 11/2012 Anderman et al.
2012/0289116 A1 11/2012 Beuerle
2013/0067640 A1 3/2013 Hefter et al.
2013/0171906 A1 7/2013 Smoot et al.
2013/0189898 A1 7/2013 Abbott
2013/0305450 A1 11/2013 Douglas
2014/0220851 A1 8/2014 Bennett
2014/0256217 A1 9/2014 Telfer
2014/0287648 A1 9/2014 Rebella et al.
2015/0231515 A1 8/2015 Vilardo et al.
2015/0314205 A1 11/2015 Rebella et al.
2016/0236106 A1 8/2016 Karsten et al.
2016/0270567 A1 9/2016 Hsu

FOREIGN PATENT DOCUMENTS

DE 8607759 7/1986
EP 1260163 11/2002
JP 63158390 10/1988
WO 9305857 4/1993
WO 2006100419 9/2006
WO 2012061302 5/2012
WO 2014030157 2/2014
WO 2015195481 12/2015

OTHER PUBLICATIONS

My Pillow Pets, About Us, available online at least as early as Feb. 20, 2011 (https://mypillowpets.com/about/).
My Pillow Pets, Homepage, available online at least as early as Jun. 10, 2007 (https://mypillowpets.com/).
Plushiemorphs, "Transforming Toys Powered by Pure Imagination," known and accessible to the public at least as early as Mar. 8, 2017, retrieved from the Internet at https://plushiemorphs.com/products-2/, 5 pages and a Statement of Relevance.

* cited by examiner

TRANSFORMABLE TOY WITH REVERSIBLE HEAD AND INTEGRATED BOOK

RELATED APPLICATIONS

This application is a Continuation-in-Part of U.S. patent application Ser. No. 15/582,044 filed on Apr. 28, 2017, the entire content of which is hereby incorporated by reference herein.

BACKGROUND

The present invention relates to toys, and in particular, to toys that transform between two or more different configurations.

SUMMARY

In accordance with one embodiment, a toy includes a body having a first side representative of a first body appearance, and a second side opposite the first side and representative of a second body appearance different from the first body appearance. The toy also includes a head coupled to the body, the head being reversible between a first face and a second face, the first face corresponding to the first body appearance and the second face corresponding to the second body appearance. When the first face of the head is exposed to view, the second face of the head is concealed from view inside the head, and when the second face of the head is exposed to view, the first face of the head is concealed from view inside the head. The toy further includes a book coupled to the second side of the body.

In accordance with another embodiment, a toy includes a body having a first side and a second side opposite the first side. The toy also includes a head coupled to the body. In a first configuration, the body is folded so that the first side defines an exterior of the toy and the second side defines an interior of the toy, and in a second configuration, the body is unfolded so that the second side is exposed to view. The toy further includes a book coupled to the second side, the book being at least partially hidden from view when the toy is in the in first configuration, and the book being fully exposed to view when the toy is in the second configuration.

In accordance with another embodiment, a toy includes a body having a first side representative of a first body appearance, and a second side opposite the first side and representative of a second body appearance different from the first body appearance. The toy also includes a head coupled to the body, the head being reversible between a first configuration corresponding to the first body appearance and a second configuration corresponding to the second body appearance. The head has a first face and a second face. When the head is in the first configuration, the first face is exposed to view to define an exterior of the head and the second face is concealed from view inside the head. When the head is in the second configuration, the second face of the head is exposed to view to define an exterior of the head and the first face of the head is concealed from view inside the head. The toy further includes a book coupled to the second side of the body, the book including indicia conveying a story about a first character and a second character, the first character corresponding to the first body appearance and the first face, and the second character corresponding to the second body appearance and the second face.

Other aspects of the invention will become apparent by consideration of the detailed description and accompanying drawings.

Figure 1:
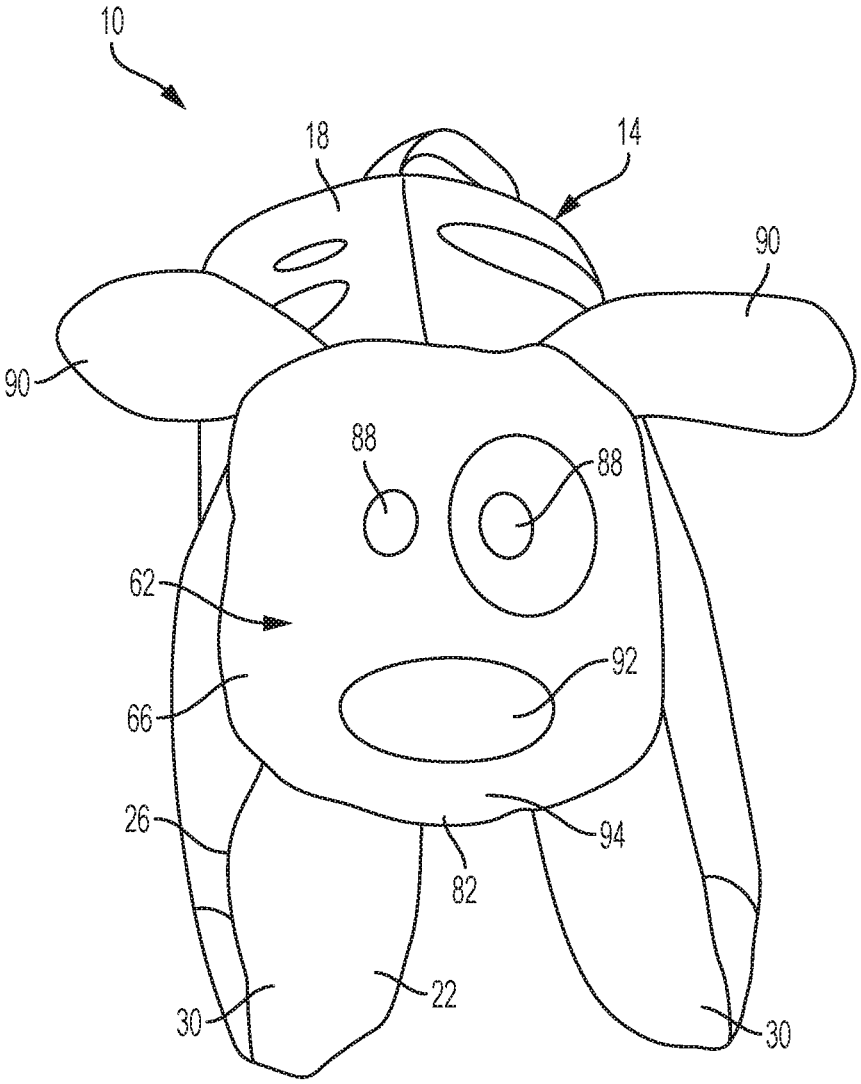
FIG. 1 is a perspective view of a toy according to one embodiment standing upright, illustrating a body having a first side representative of a first body appearance, and a head that is in a first configuration that corresponds to the first body appearance.

Before any embodiments of the invention are explained in detail, it is to be understood that the invention is not limited in its application to the details of embodiment and the arrangement of components set forth in the following description or illustrated in the following drawings. Use of relative terms such as "right," "left," "front side," "backside," "lower,""upper," "over," "under," "up," "down," "top," and "bottom," as well as derivatives of such terms (e.g., "downwardly" and "upwardly") should be construed to refer to exemplary orientation as then described or as shown in the drawing under discussion. These relative terms are for convenience of description and do not require that the apparatus be constructed or operated in a particular orientation. The invention is capable of other embodiments and of being practiced or of being carried out in various ways. Also, it is to be understood that the phraseology and terminology used herein is for the purpose of description and should not be regarded as limiting in nature.

DETAILED DESCRIPTION

FIGS. 1-9 illustrate a toy 10 according to a first embodiment of the present invention. The toy 10 is transformable to display a first image, design, character or object in a first state, and to display a second different image, design, character or object in a second state. The images or characters that may be displayed include, for example, commonly known movie or television characters, animated characters, animals, humans, inanimate objects, fantasy creatures or characters, historical characters, characters from books or other sources, or other articles, whether real or imagined. The materials used to form the toy 10 may be any suitable materials, including plush fabric, knit fabric, woven fabric, plastic, rubber, or any other suitable material for use as a toy.

The illustrated toy 10 is a folding plush toy and includes a body 14 having a first side 18 representative of a first body appearance (i.e., a body of a puppy in the illustrated embodiment), and a second opposite side 22 representative of a second body appearance (i.e., a body of a baby seal in the illustrated embodiment) that is different than the first body appearance. The body 14 includes a perimeter 26 (e.g., a single seam) that extends around an outer periphery of the body 14. The perimeter 26 separates the first side 18 of the body 14 from the second side 22 of the body 14. In the illustrated embodiment, the body 14 includes two front legs 30 and two rear legs 34, although other embodiments may include different numbers of legs, arms and/or other appendages or features, as well as different shapes and sizes for the body 14 other than that illustrated. In some embodiments, the body 14 includes no arms, legs or other appendages. As illustrated in FIGS. 1-9, the body 14 may be flipped over upside down (i.e., 180 degrees) such that either the first body appearance (i.e., the body of the puppy) is visible, or the second body appearance (i.e., the body of the baby seal) is visible. The body 14 is made of a plush material, and is filled with stuffing material (e.g., cotton, polyester fiber, etc.) to form a three-dimensional structure, although other embodiments include bodies 14 that are generally flatter, thicker, or have shapes other than that illustrated, and/or are made of other materials or include different stuffing materials. The different body appearances can be created, for example, by using different colors, textures, patterns, materials, pile heights, appendages, and the like for the two sides 18, 22 of the body 14.

With reference to FIGS. 2, 3, and 5-8, the toy 10 further includes a fastening arrangement 38 coupled to the body 14 and operable for drawing two opposite edges 42, 46 of the perimeter 26 toward each other (i.e., to fold the toy 10). In the illustrated embodiment, the fastening arrangement 38 includes a first strap 50 (FIGS. 3 and 8) coupled (e.g., stitched via a seam) to the first edge 42, and a second strap 54 (FIGS. 2-8) coupled (e.g., stitched via a seam) to the second edge 46. The first edge 42 is positioned between one of the two front legs 30 and one of the two rear legs 34 of the body 14, and the second edge 46 is positioned between the other front leg 30 and the other rear leg 34 of the body 14. The first strap 50 and the second strap 54 include hooks and fasteners (e.g., Velcro®) to connect and disconnect the first and second straps 50, 54, and to either keep the two opposite edges 42, 46 pulled together (FIGS. 1, 2, 8, 9), or to release the two opposite edges 42, 46 (FIGS. 3-7). In some embodiments, the second strap 54 loops through the first strap 50 (see FIGS. 21A-E discussed below) or a buckle on one of the straps 50, 54 (i.e., frictional connection). In other embodiments, the second strap 54 includes a mating component at an end of the second strap 54 that latches into a buckle on the first strap 50. Other embodiments include various other types of fastening arrangements 38, including fastening arrangements having buttons and/or a single strap or more than two straps.

With reference to FIGS. 1-9, the toy 10 further includes a head 62 coupled to the body 14 (e.g., stitched to the body 14 via a seam). The head 62 is reversible between a first configuration (FIGS. 1-3) where a first face 66 (i.e., a face of the puppy in the illustrated embodiment) is visible, and a second configuration (FIG. 69) where a second face 70 (i.e., a face of the baby seal in the illustrated embodiment) is visible. The first configuration of the head 62 and the first face 66 corresponds to the first body appearance (i.e., the face of the puppy corresponds to the body of the puppy), and the second configuration of the head 62 and the second face 70 corresponds to the second body appearance (i.e., the face of the baby seal corresponds to the body of the baby seal).

The correspondence between the respective faces and body appearances can include, but is not limited to, the same or similar colors, textures, patterns, materials, pile heights, appendages, and the like for both the face and the corresponding side of the body. In other words, a user will be able to determine which face matches or corresponds to which body appearance. Furthermore, as will be discussed further below, the configurations of the head 62 provide for two different face orientations, such that the appropriate face will be properly oriented relative to the matching body appearance, as dictated by which side 18, 22 of the body 14 is outwardly facing.

Figure 3:
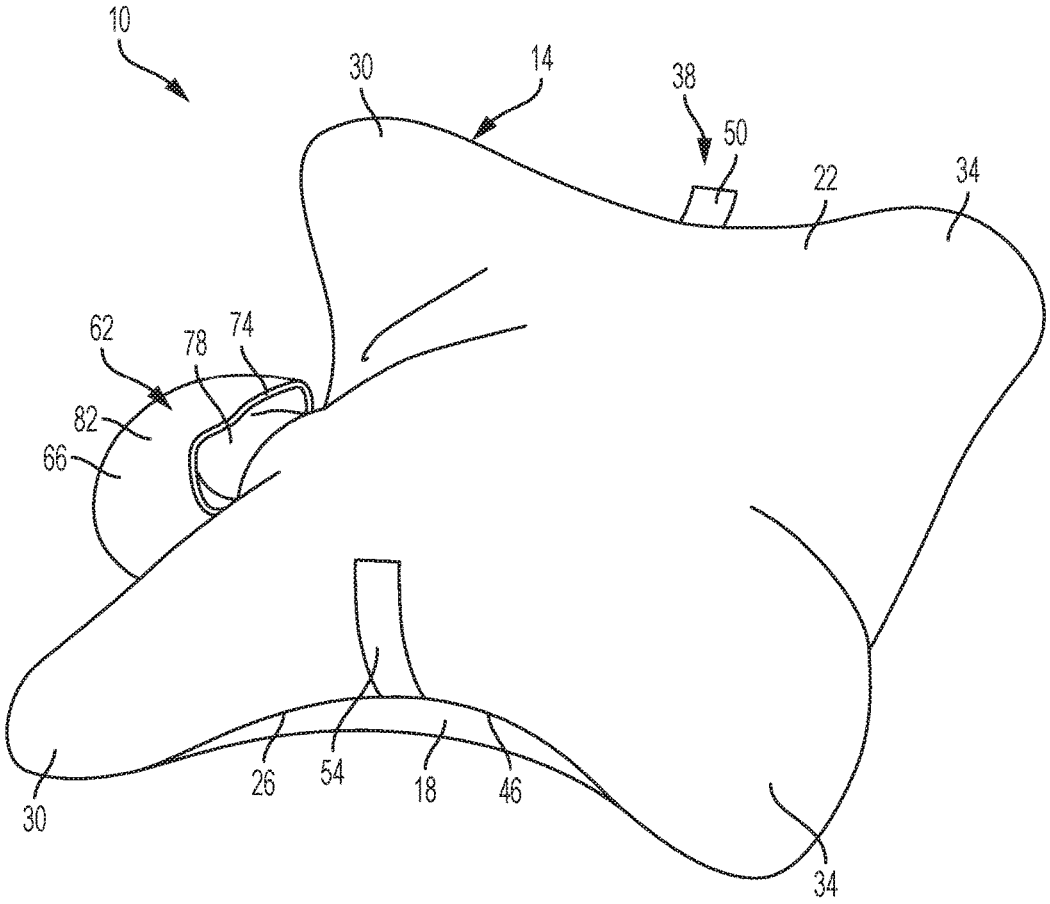
FIG. 3 is a perspective view of the toy after the fastening arrangement has been disconnected, illustrating a second side of the body representative of a second body appearance.
Figure 4:
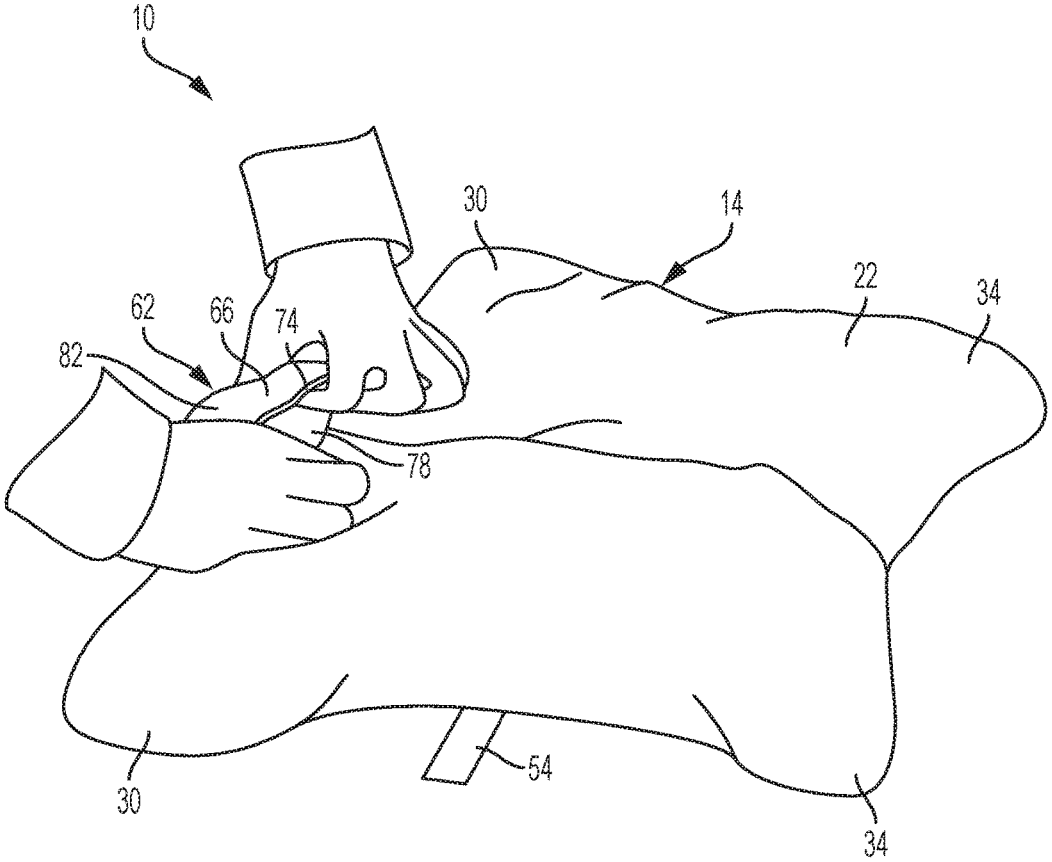
FIG. 4 is a perspective view of the toy, illustrating a seam of the head that defines an opening in the head, and a user inserting her hand past the seam and into the opening.

As illustrated in FIGS. 3 and 4, the first face 66 and the second face 70 are joined together around one edge along a seam 74 to form a sock-like or pouch-like structure with an opening 78 defined by the edge/seam 74. The head 62 thus forms a reversible pouch. That is, when one of the faces is on the exterior of the head 62 visible to view, the other face is on the interior of the head 62 inside the pouch and concealed from view. In the illustrated embodiment, the head 62 is coupled to the body 14 along a portion of the seam 74 to leave the entire opening 78 accessible to a user. In the illustrated embodiment, the head 62 is sewn to the body 14 along ⅓ to ½ of the perimeter of the opening 78. Other embodiments may have the head 62 sewn or otherwise coupled to the body 14 along more or less of the perimeter of the opening 78. The opening 78 is sized and configured to receive a user's hand inside the head 62 to change the configuration of the head 62 as explained below or to manipulate one or more areas of the head 62 like a puppet (e.g., to manipulate a mouth). For example, a user may place his or her hand into the opening 78 to manipulate upper and lower jaw portions to provide the appearance that the mouth is moving.

The head 62 is reversible (i.e., may be flipped or pulled inside out) through the opening 78 to convert the head 62 between the first configuration (corresponding to the first face 66 exposed to view) and the second configuration (corresponding to the second face 70 exposed to view). For example, the head 62 is reversible from the first face 66 to the second face 70 (i.e., from the first configuration to the second configuration) by grasping and pulling the second face 70 located inside the head 62 out through the opening 78. In a similar manner, the head 62 is reversible from the second face 70 to the first face 66 (i.e., from the second configuration back to the first configuration) by grasping and pulling the first face 66 located inside the head out through the opening 78. Thus, the head 62 is changeable between the first and second configurations much like flipping a sock inside out and then back outside in through the opening for inserting a foot.

The head 62 may thus be considered like a reversible pouch (i.e., like the sock), where, for example, the pouch is reversible from the first configuration to the second configuration by grasping and pulling the second face 70 (which defines the interior surface of the pouch in the first configuration) out of the pouch through the opening 78. Likewise, the pouch is reversible from the second configuration to the first configuration by grasping and pulling the first face 66 (which defines the interior surface of the pouch in the second configuration) out of the pouch through the opening 78.

With reference to FIGS. 1-9, when the first face 66 of the head 62 is exposed to view (FIGS. 1-3), the second face 70 of the head 62 is concealed from view inside the head 62 in the pouch-like interior formed by the first face 66. When the second face 70 of the head 62 is exposed to view (FIGS. 6-9), the first face 66 of the head is concealed from view inside the head 62 in the pouch-like interior formed by the second face 70. Thus, when the head 62 is in the first configuration (FIGS. 1-3), the first face 66 defines an exterior of the head 62, and the second face 70 defines an interior of the head 62. When the head 62 is in the second configuration (FIGS. 6-9), the second face 70 defines an exterior of the head 62, and the first face 66 defines an interior of the head 62.

As explained above, with reference to FIGS. 1-9, the toy 10 may initially be in a first state such as that illustrated in FIG. 1, where the first side 18 of the body 14 (i.e., corresponding to the body of the puppy) is visible and generally externally-facing, and where the head 62 is in the first configuration (i.e., corresponding to the head of the puppy) with the first face 66 fully visible. In this first state, the fastening arrangement 38 is connected, such that the opposite edges 42, 46 of the body 14 are pulled together, and the toy 10 can stand upright as a first character (i.e., a standing puppy).

Figure 2:
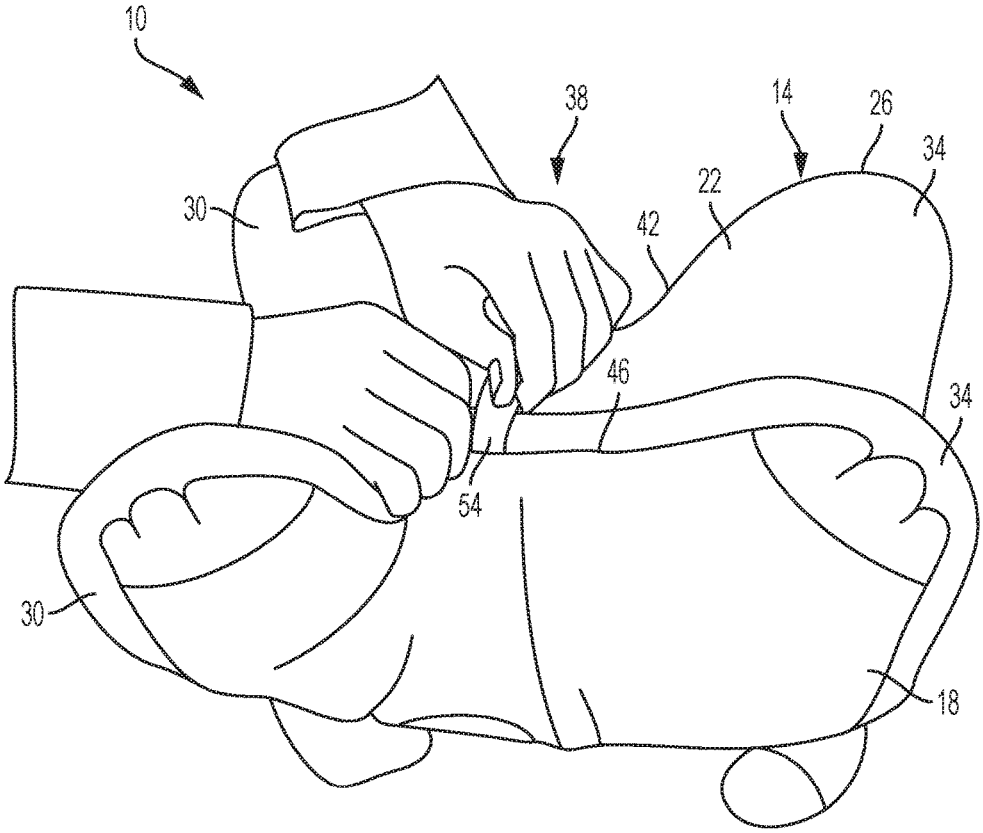
FIG. 2 is a perspective view of the toy after the toy has been flipped upside down, illustrating a fastening arrangement being disconnected.

With reference to FIG. 2, to convert the toy 10 to the second state depicting another or second character (i.e., to the baby seal), the user first disconnects the fastening arrangement 38. As illustrated in FIG. 2, the user may do this by flipping the toy 10 upside down (i.e., flipping the toy 10 over 180 degrees), such that the front legs 30 and the rear legs 34 extend upright into the air. The first strap 50 and the second strap 54 are then disconnected.

With reference to FIG. 3, once the fastening arrangement 38 has been disconnected, the body 14 naturally flattens out (i.e., the front legs 30 spread apart from one another and the rear legs 34 spread apart from one another), and the second side 22 of the body 14 (i.e., corresponding to the body of the baby seal) becomes fully visible.

Figure 5:
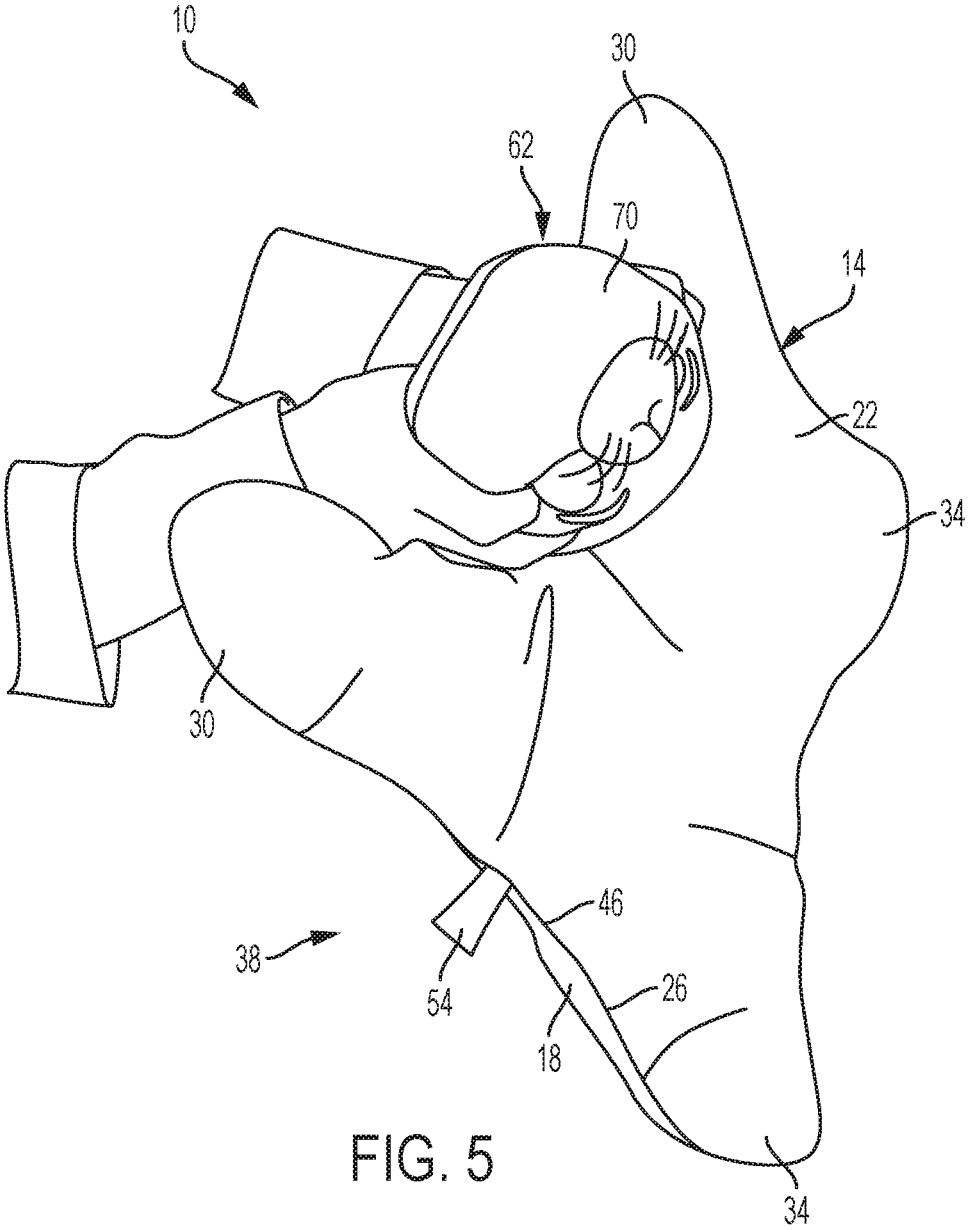
FIG. 5 is a perspective view of the toy, illustrating the user reversing the head from the first configuration to a second configuration that corresponds to the second body appearance.
Figure 6:
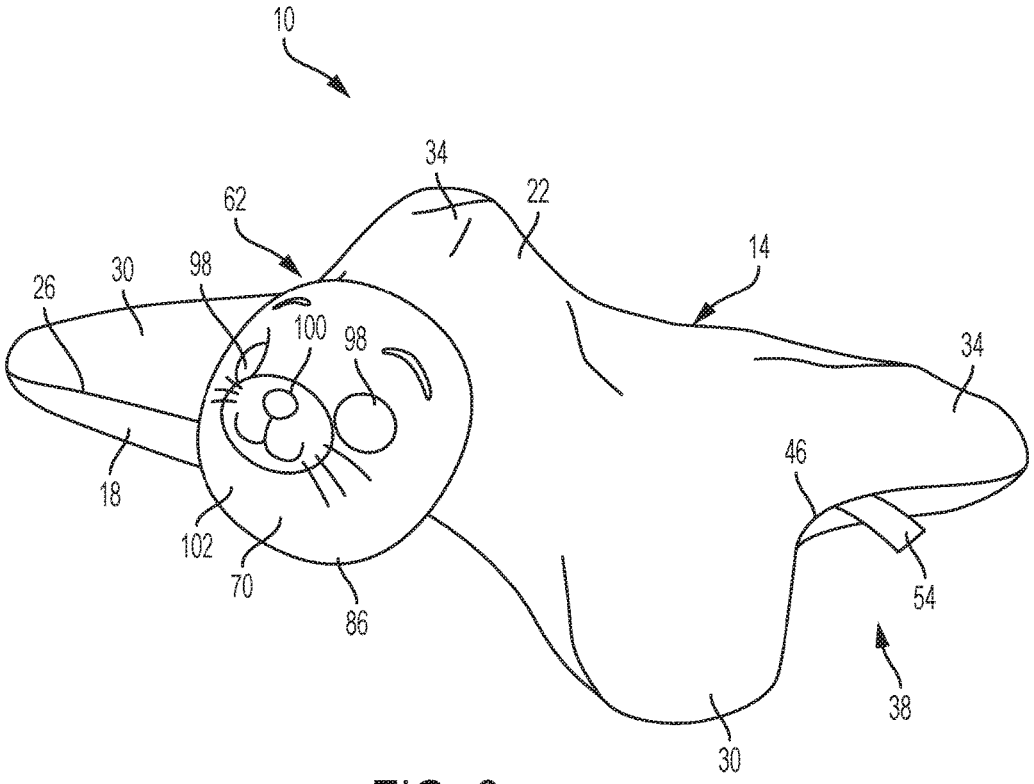
FIG. 6 is a perspective view of the toy, after the head has been reversed to the second configuration.

With reference to FIGS. 4-6 and as discussed above, the user can change the head 62 from the first configuration which displays the first face 66 to the second configuration to display the second face 70 by grasping a portion of the material inside of the head 62 (that is, grasping the second face 70 inside of the reversible pouch) and pulling the second face 70 out of the reversible pouch through opening 78 and past the seam 74. At the same time, to assist in changing the head 62 from the first configuration to the second configuration, the user can also simultaneously push the first face 66 into the pouch as the pouch is reversed. As illustrated in FIG. 6, once the head 62 has been reversed, the second face 70 is revealed to view and the first face 66 is concealed from view within the head 62.

Figure 7:
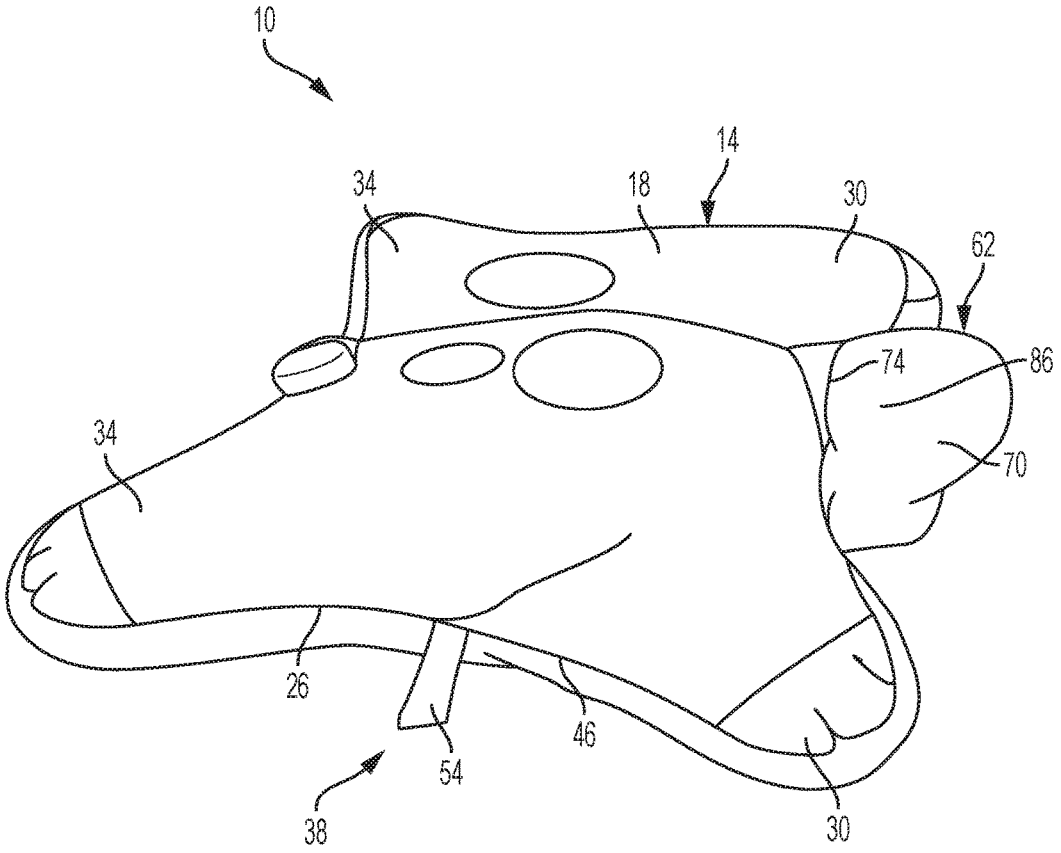
FIG. 7 is a perspective view of the toy after the toy has been flipped over again.
Figure 8:
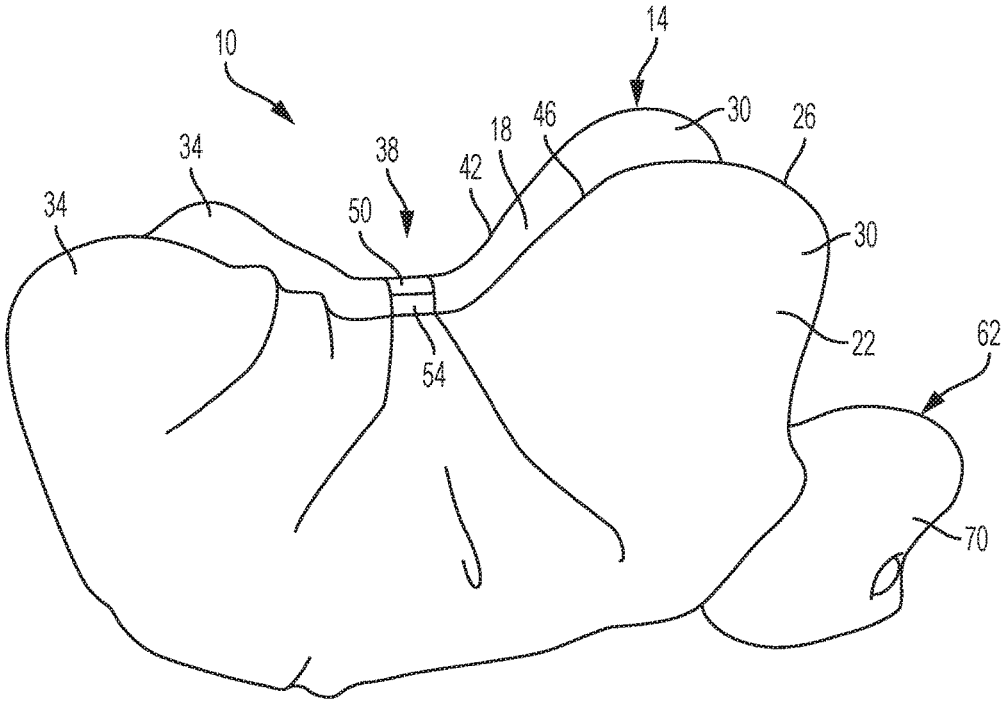
FIG. 8 is a perspective view of the toy, illustrating the embodiment of FIG. 7 fastened together.

As explained, the second face 70 corresponds to the second body appearance depicted on the second side 22 of the body 14. With reference to FIGS. 7 and 8, the user can then flip the body 14 over from the first side 18 to the second side 22 and reconnect the fastening arrangement 38 by pulling and fastening the first strap 50 and the second strap 54 together. This reconnection pulls the two opposite edges 42, 46 of the perimeter 26 toward each other again, now with the second side 22 being generally externally-facing and the first side 18 being generally internally-facing.

Figure 9:
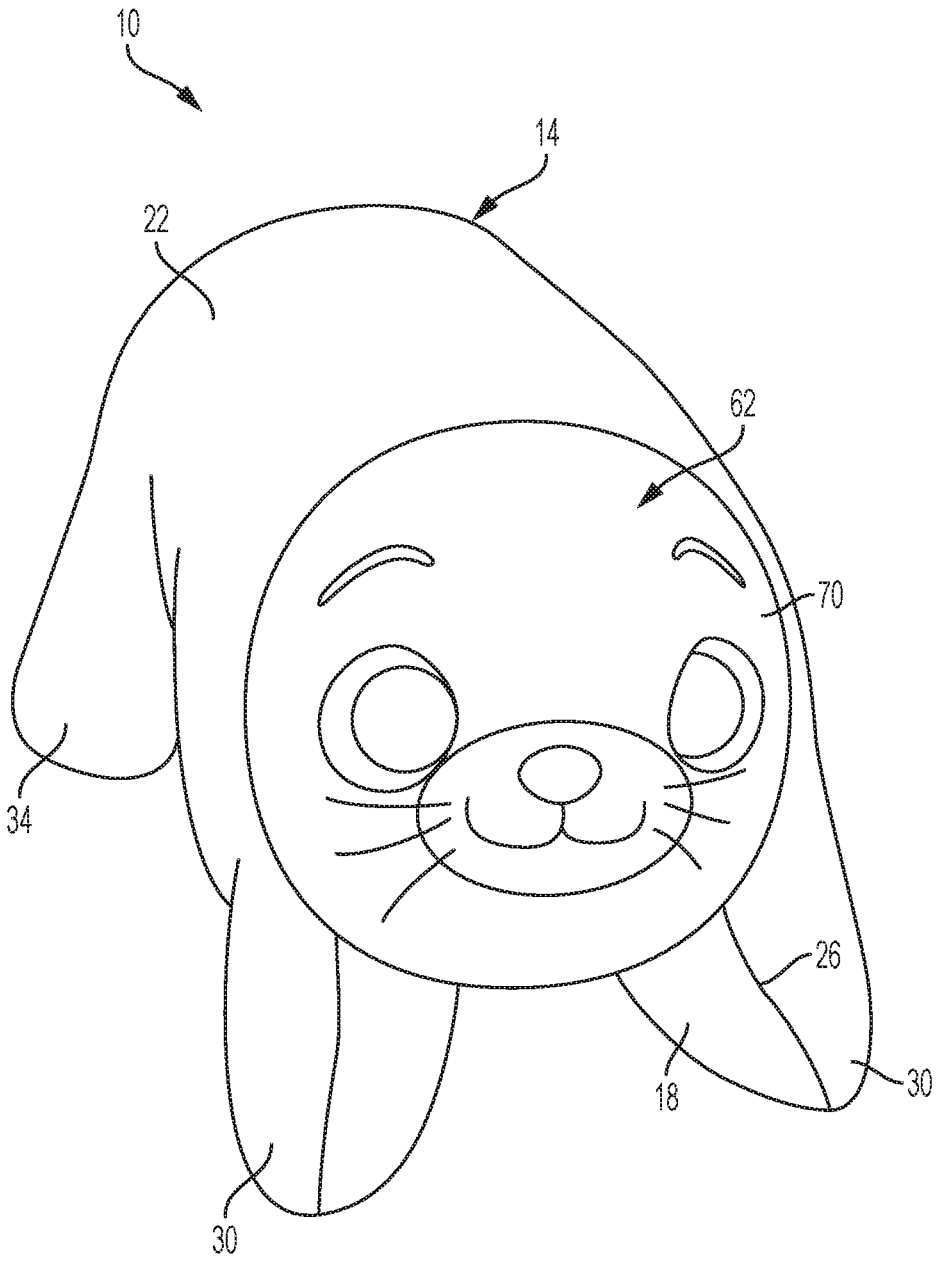
FIG. 9 is a perspective view of the toy standing upright, illustrating the second side of the body representative of the second body appearance, and the head that is in the second configuration that corresponds to the second body appearance.
Figure 10:
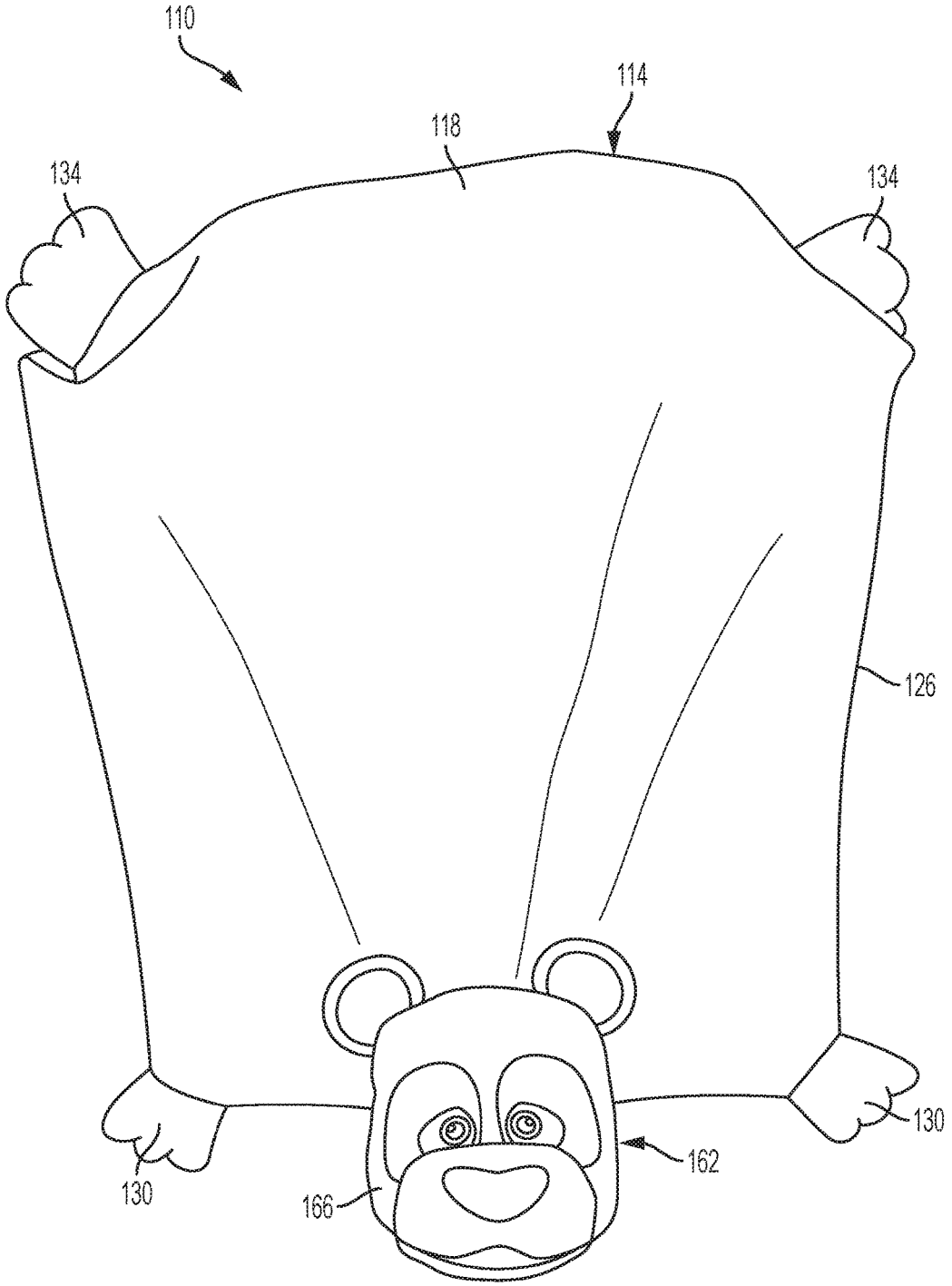
FIG. 10 is a perspective view of a toy according to another embodiment, illustrating a body having a first side representative of a first body appearance, and a head that is in a first configuration that corresponds to the first body appearance.
Figure 11:
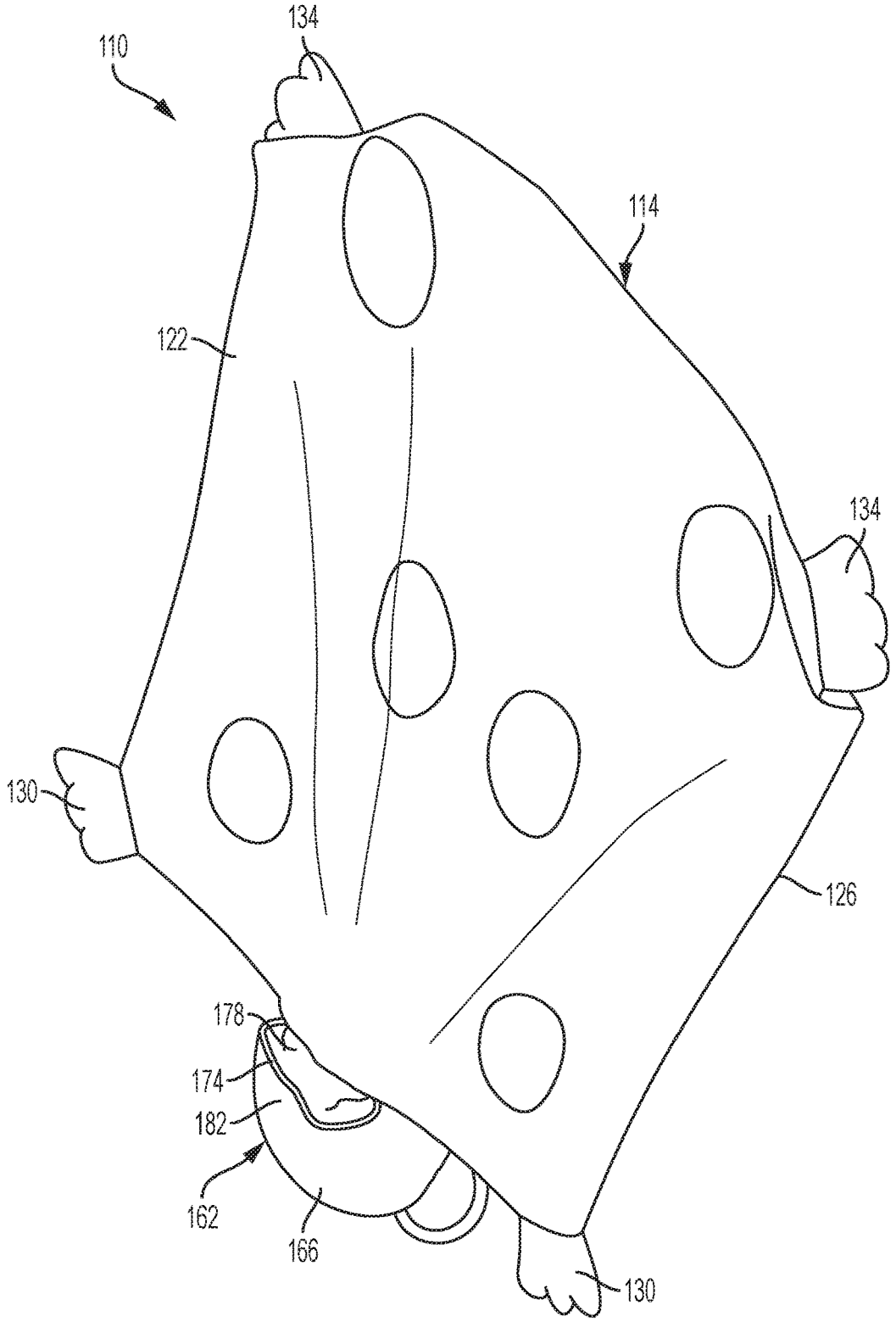
FIG. 11 is a perspective view of the toy of FIG. 10, illustrating a second side of the body representative of a second body appearance.

As shown in FIG. 9 the user can then stand the toy 10 upright in the second state. The second side 22 of the body 14 representative of the second body appearance and the second face 70 of the head 62 are then both visible (i.e., like a standing baby seal).

The steps described above to change the toy 10 from one configuration to another need not be performed in the same order as recited above, but in any order a user finds convenient. For example, the step of reversing the head 62 may be performed at any time during the process of converting the toy 10 between the first state and the second state (i.e., before disconnecting and/or connecting of the first and second strap 50, 54, and/or before flipping the body 14 over from one side to the other side).

In changing the toy 10 from one state to another, the user may find it convenient to hold the body 14 stationary while reversing the configuration of the head 62. If the body 14 is held stationary while the head 62 is changed between configurations, for example from the first configuration to the second configuration, when the second face 70 becomes visible the face 70 will be oriented upside down or opposite relative to the previously-visible first face 66. In more detail, the first face 66 includes a chin 82 with an underside that faces away from the first side 18 of the body 14 when the first face 66 is visible and the body 14 is oriented as shown in FIG. 4 in a relatively flattened configuration. That is, the underside of the chin 82 of the first face 66 will face in the same general direction as the second side 22 of the body 14 in the orientation of FIG. 4. Conversely, the second face 70 includes a chin 86 with an underside that faces away from the second side 22 of the body 14 when the second face 70 is visible and the body 14 is oriented as shown in FIG. 6. As illustrated in FIG. 1, the first face 66 further includes two eyes 88, two ears 90, a snout 92, and at least one jaw 94 (e.g., that may be manipulated as described above when the toy 10 is a puppet). As illustrated in FIG. 6, the second face 70 likewise includes two eyes 98, a snout 100, and at least one jaw 102 (e.g., that may be manipulated as described above when the toy 10 is a puppet).

The seam 74 and the opening 78 are always located underneath and behind the chins 82, 86 of the head 62 in both configurations of the head 62. As a result, the first face 66 will always be oriented when visible to correspond to the first side 18 of the body 14 and the second face 70 will always be oriented when visible to correspond to the second side 22 of the body 14. Put another way, each face 66, 70 will be visible on a side of the head 62 opposite from the side of the head 62 on which the other face is visible. When the body 14 is in a standing configuration with the first side 18 facing as shown in FIG. 1, the underside of the chin 82 of the first face 66 will face downwardly toward the legs 30, 34 (and toward the support surface on which the legs 30, 34 rest). If the head 62 is then reversed without any change to the body 14, the underside of the chin 86 of the second face 70 would face upwardly away from the legs 30, 34 (and away from the support surface on which the legs 30, 34 rest). With this arrangement, if the body 14 is then flipped over with the second face 70 still visible to reverse the body appearance, the second face 70 will be in a proper orientation relative to the body 14 so that the second face 70 corresponds with the second side 22 of the body 14. This construction thus serves to help in corresponding each face to the matching body appearance.

FIGS. 10-15 illustrate a toy 110 according to a second embodiment of the present invention. Similar to the toy 10, the toy 110 is transformable to display a first image, design, character or object in a first state, and to display a second different image, design, character or object in a second state. The images or characters that may be displayed include, for example, commonly known movie or television characters, animated characters, animals, humans, inanimate objects, fantasy creatures or characters, historical characters, characters from books or other sources, or other articles, whether real or imagined. The materials used to form the toy 110 may be any suitable materials, including plush fabric, knit fabric, woven fabric, plastic, rubber, or any other suitable material for use as a toy.

The toy 110 includes a body 114 having a first side 118 representative of a first body appearance (i.e., a body of a panda in the illustrated embodiment), and a second opposite side 122 representative of a second body appearance (i.e., a body of a spotted dragon in the illustrated embodiment) that is different than the first body appearance. The body 114 includes a perimeter 126 (e.g., a single seam) that extends around an outer periphery of the body 114. The perimeter 126 separates the first side 118 of the body 114 from the second side 122 of the body 114. In the illustrated embodiment, the body 114 includes two front legs 130 and two rear legs 134, although other embodiments may include different numbers of legs and/or arms, as well as different shapes and sizes for the body 114 than that illustrated. In some embodiments, the body 114 includes no arms or legs. As illustrated in FIGS. 10-15, the body 114 may be flipped over 180 degrees to change between the two body appearances such that either the first or second body appearance (i.e., either the body of the panda or the spotted dragon) is visible. The body 114 is flat, and made of a material without any stuffing material inside, although other embodiments include bodies 114 that are made of other materials or include stuffing materials inside. In the illustrated embodiment, the body 114 defines a blanket. The different body appearances can be created, for example, by using different colors, textures, patterns, materials, pile heights, appendages, and the like for the two sides 118, 122 of the body 114.

With reference to FIGS. 10-15, the toy 110 does not include a fastening arrangement. Thus, unlike the embodiment of FIGS. 1-9, the body 114 is not designed to be manipulated into a secured standing position. Other embodiments, however, may include a fastening arrangement such as the fastening arrangement 38 described above.

With continued reference to FIGS. 10-15, the toy 110 further includes a head 162 coupled to the body 114 (e.g., stitched to the body 114 via a seam). The head 162 is reversible between a first configuration and a second configuration in a manner identical to that described above for the head 62. Thus, like parts have been given reference numerals increased by 100.

Figure 12:
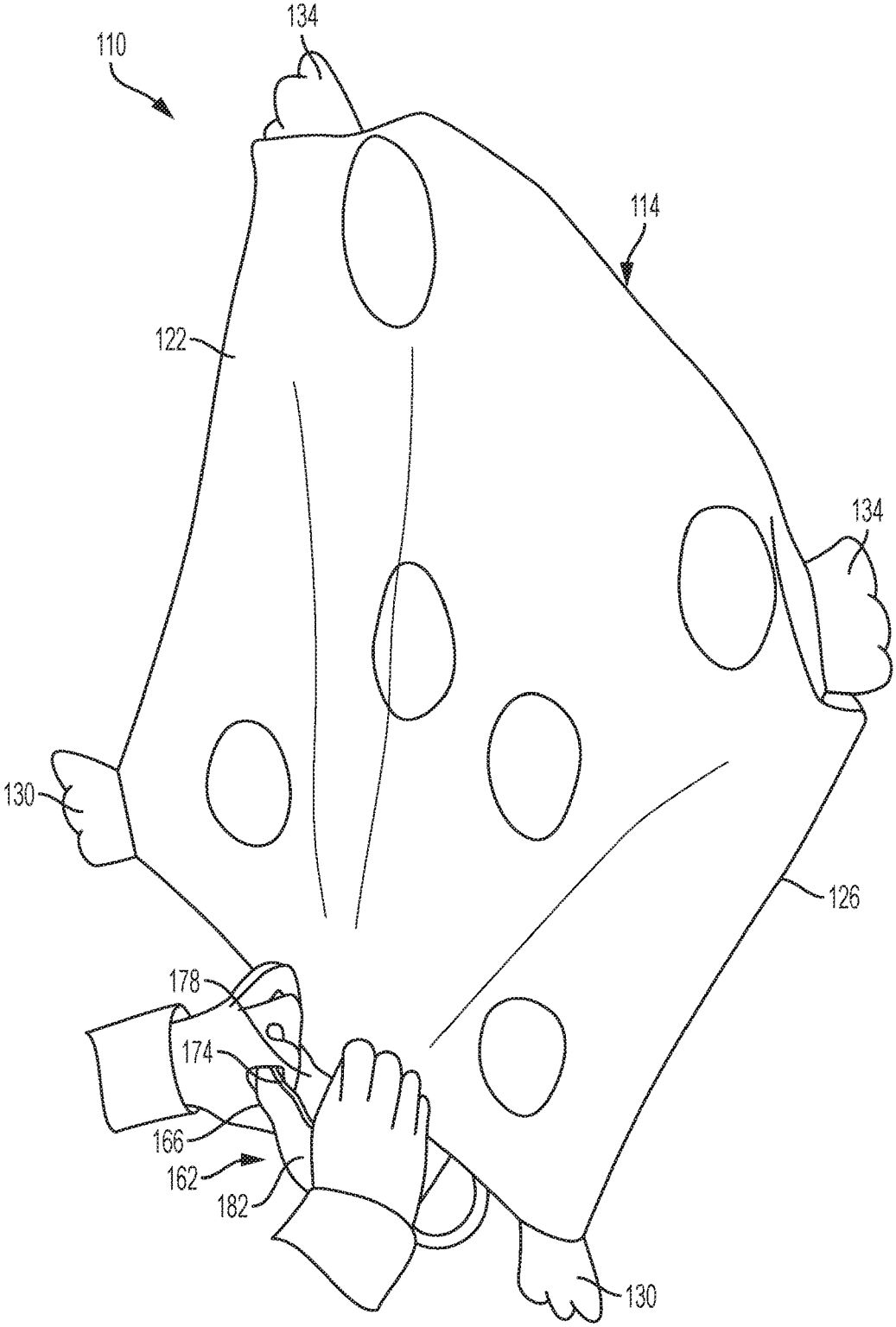
FIG. 12 is a perspective view of the toy of FIG. 10, illustrating a seam of the head that defines an opening in the head, and a user inserting her hand past the seam and into the opening.
Figure 12A:
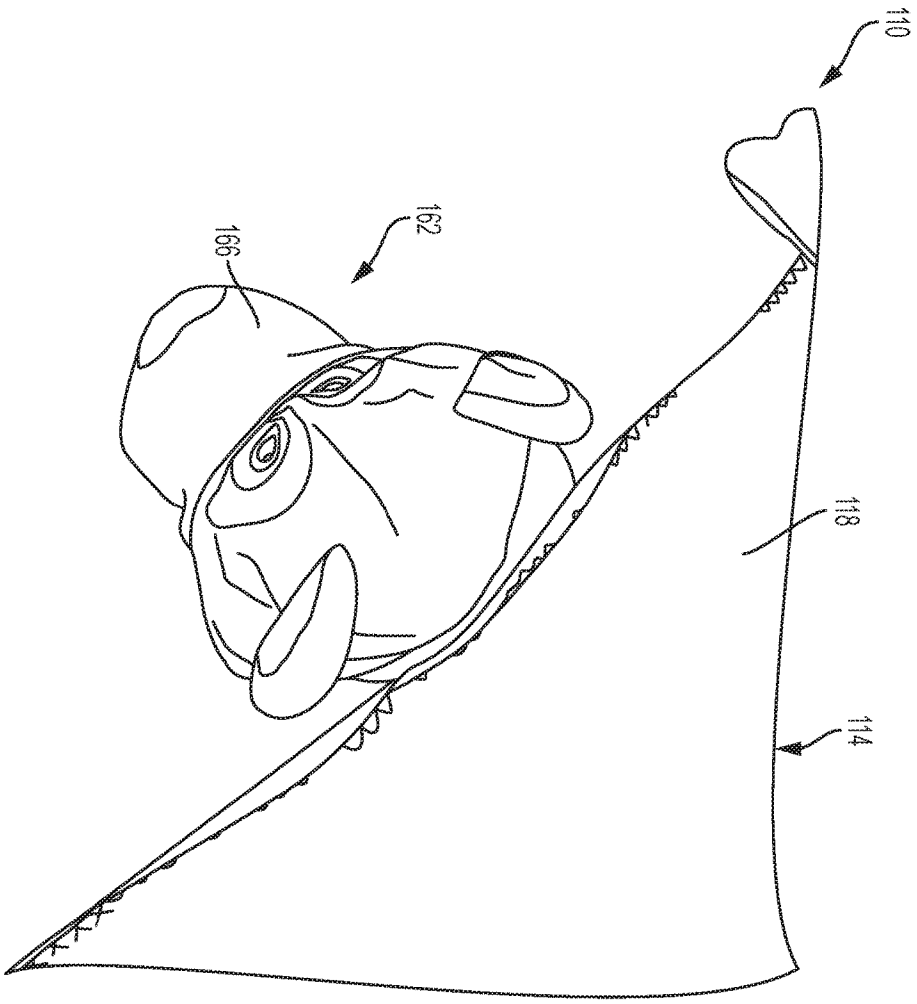
FIGS. 12A-12G are perspective views of the toy of FIG. 10, further illustrating transformation of a head between a first configuration and a second configuration.
Figure 12B:
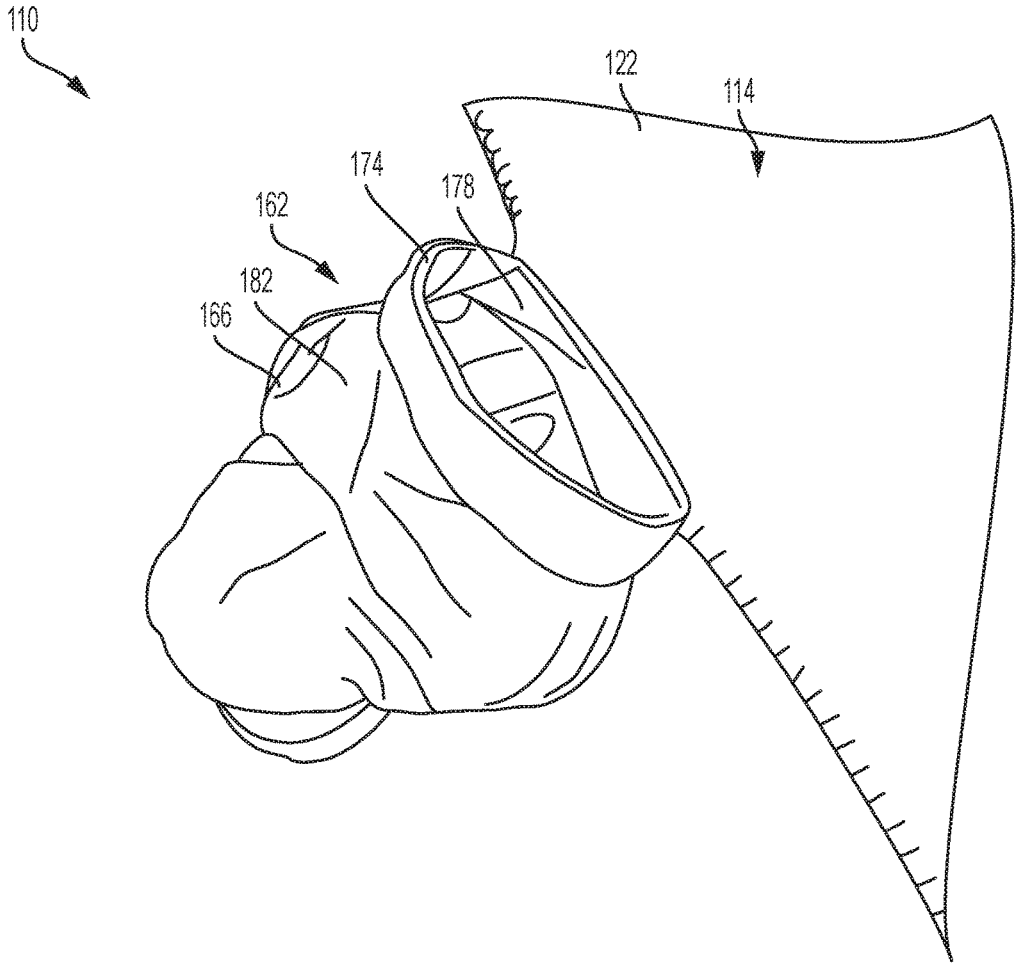
Figure 12C:
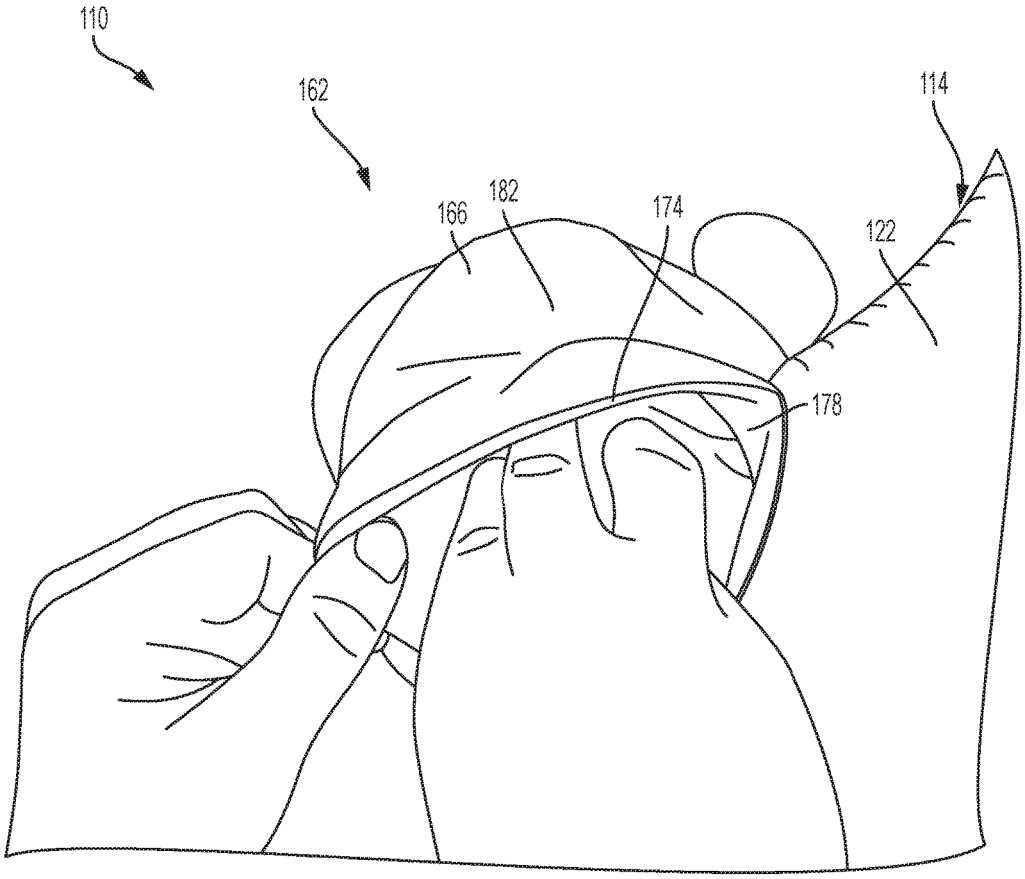
Figure 12D:
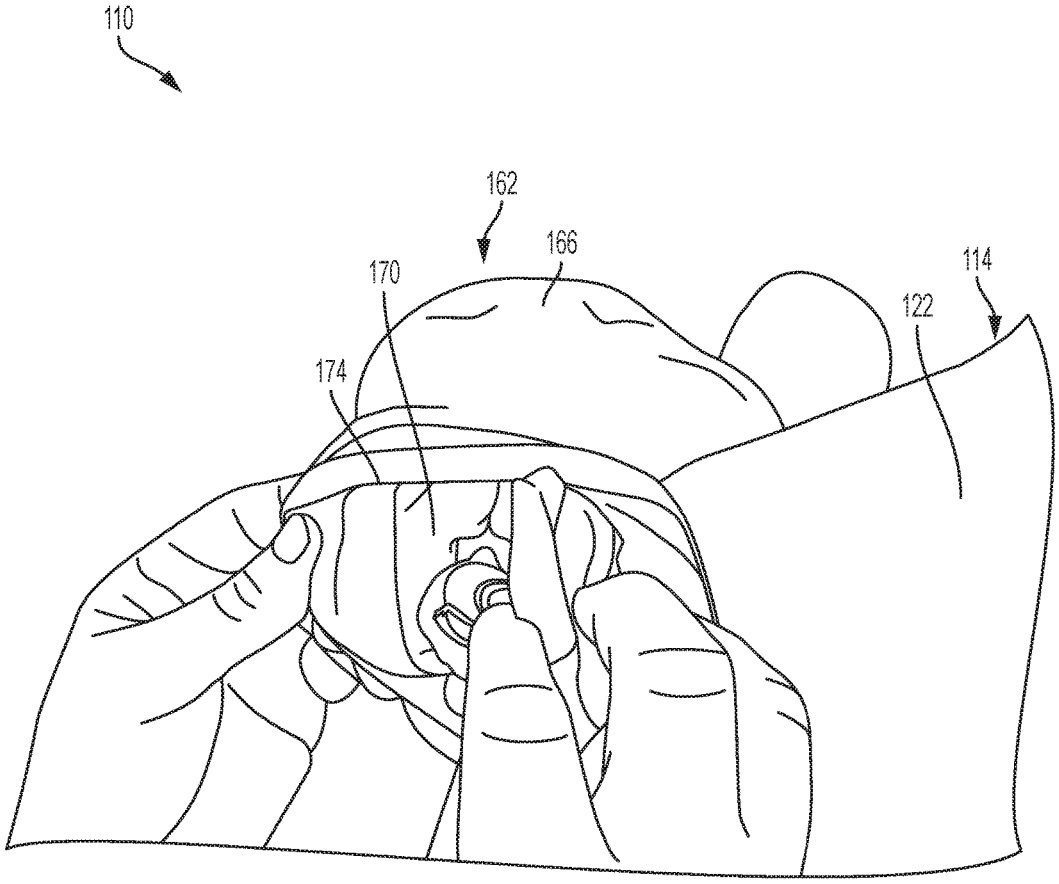
Figure 12E:
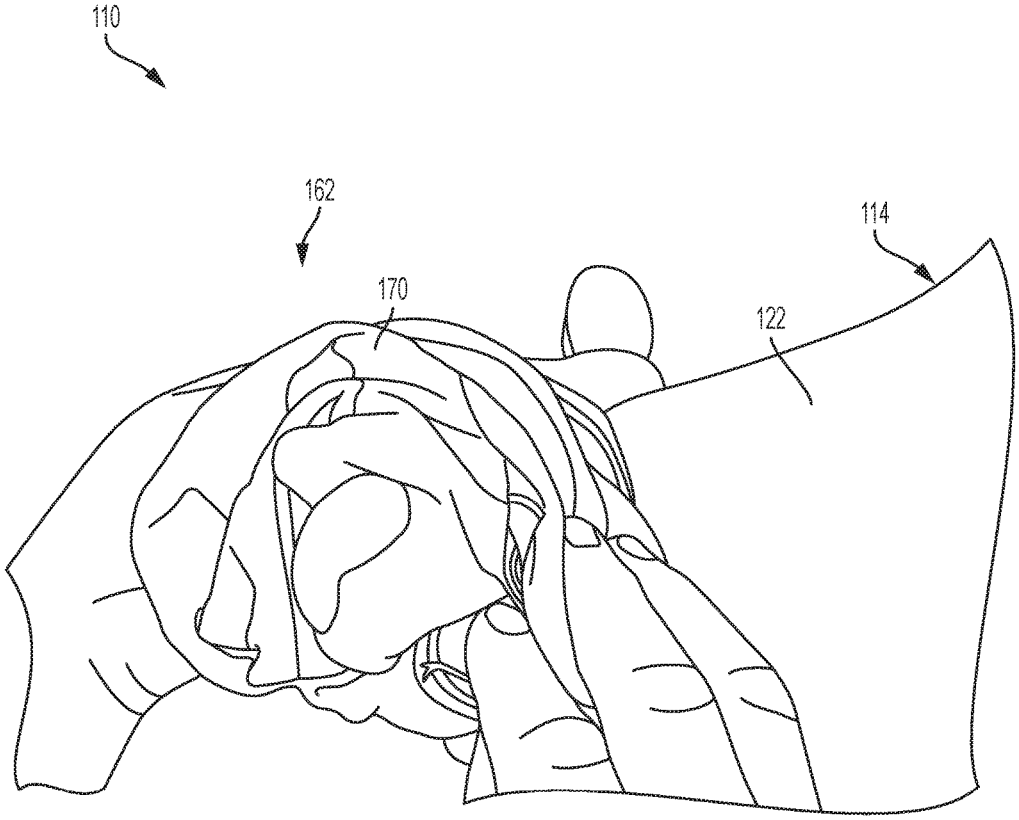
Figure 12F:
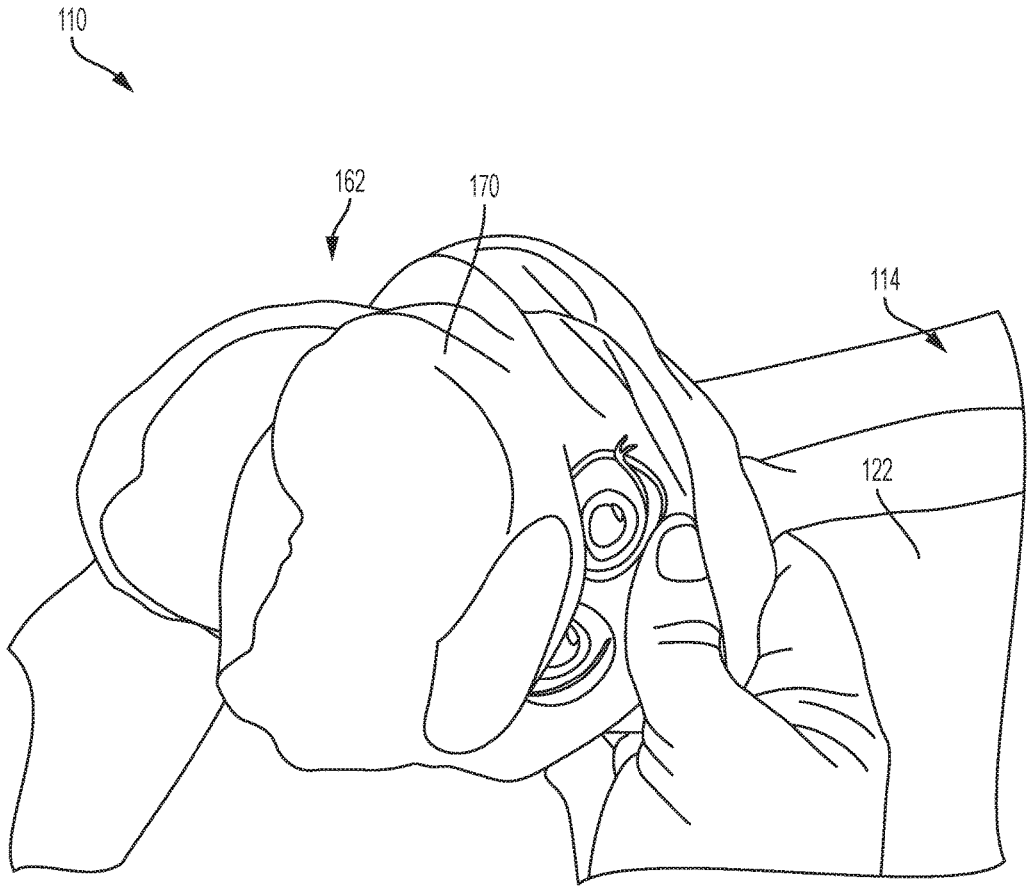
Figure 12G:
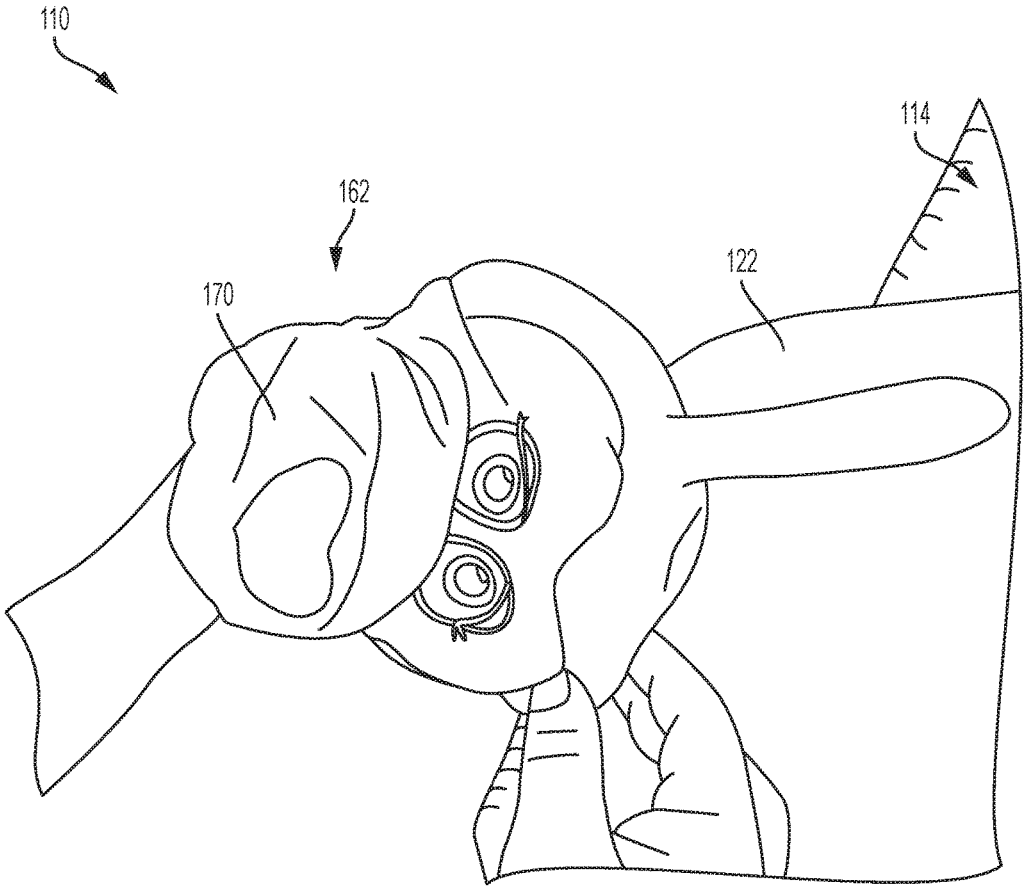
Figure 13:
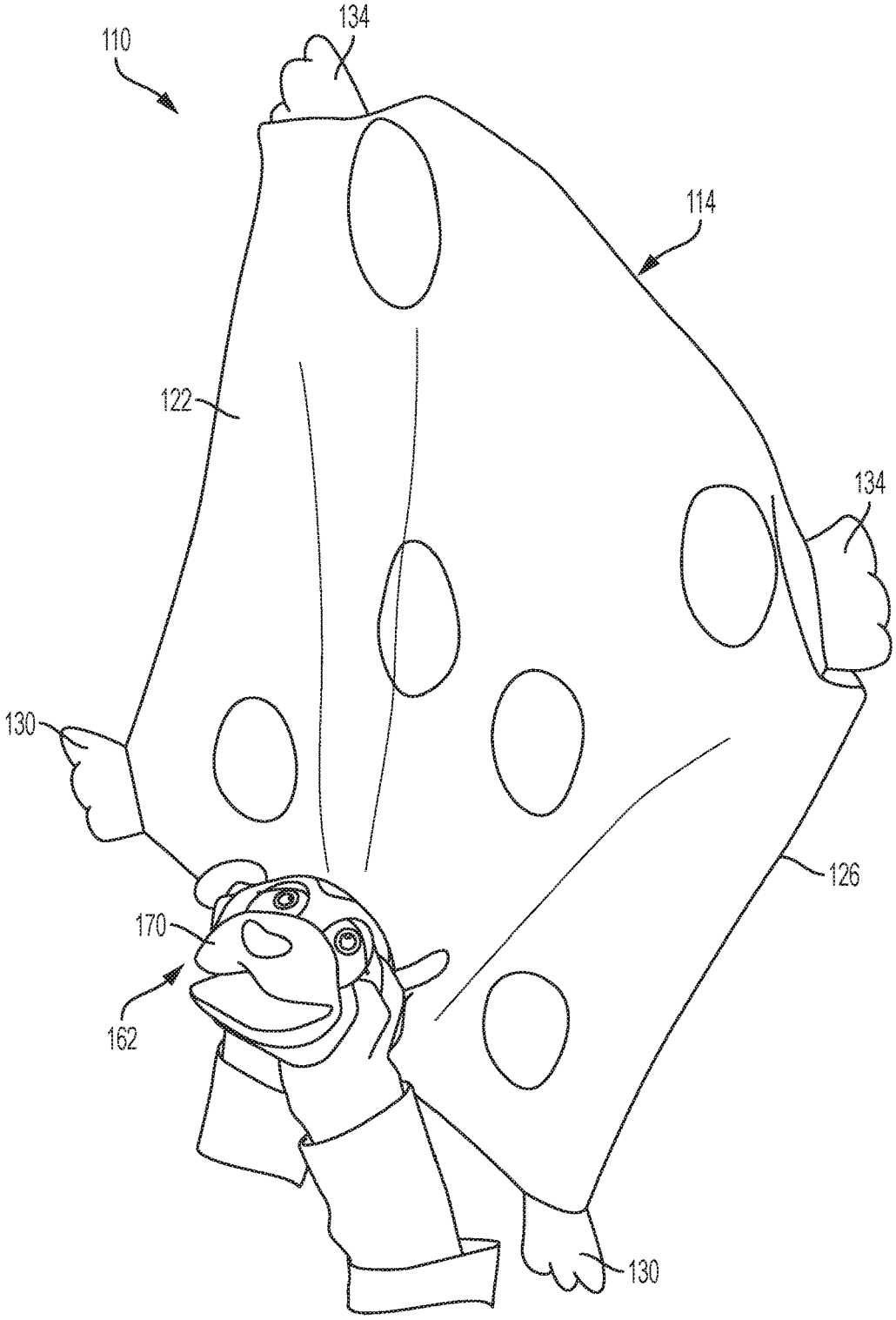
FIG. 13 is a perspective view of the toy of FIG. 10, illustrating the user reversing the head from the first configuration to a second configuration that corresponds to the second body appearance.
Figure 14:
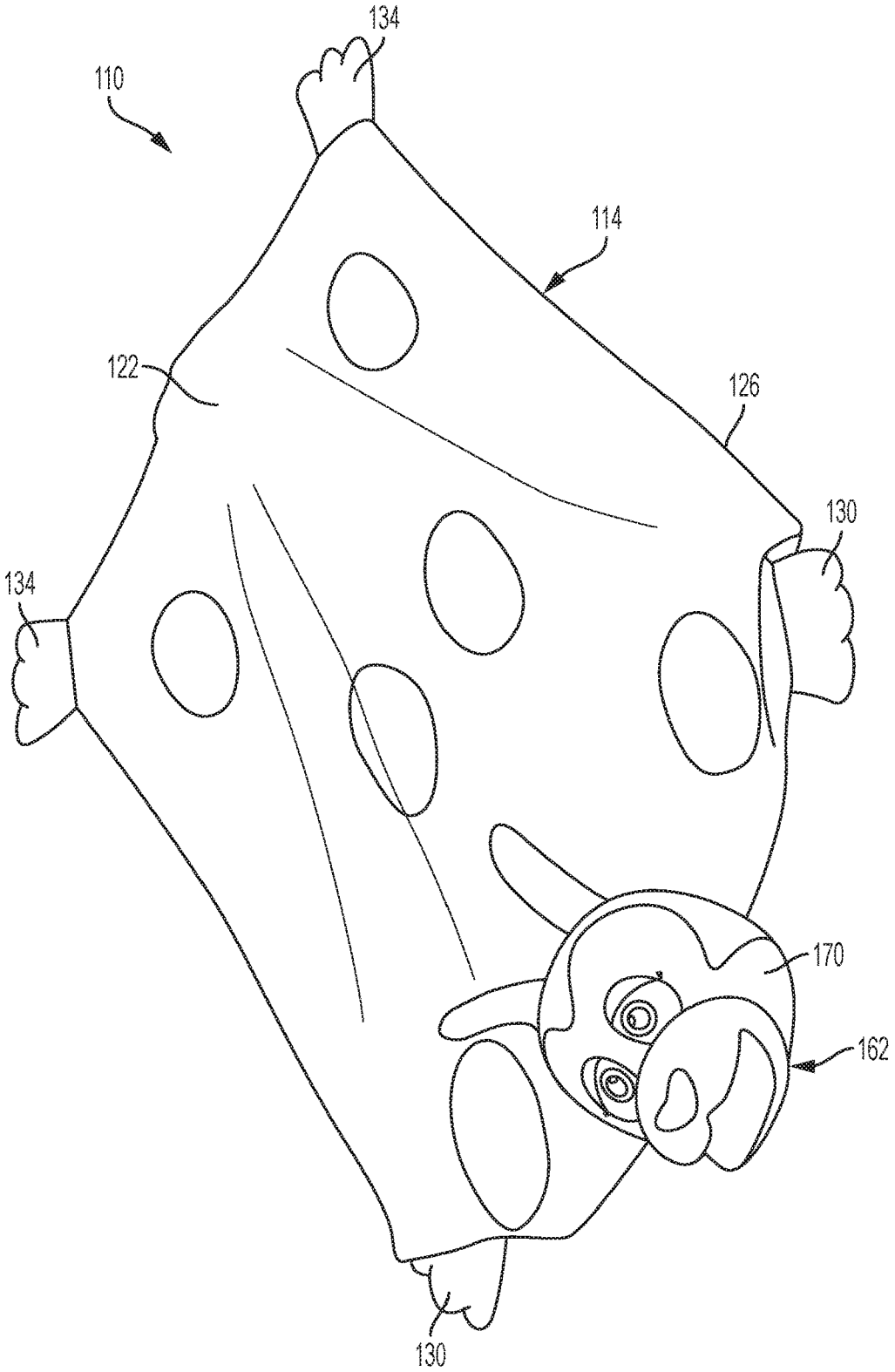
FIG. 14 is a perspective view of the toy of FIG. 10, after the head has been reversed to the second configuration.
Figure 15:
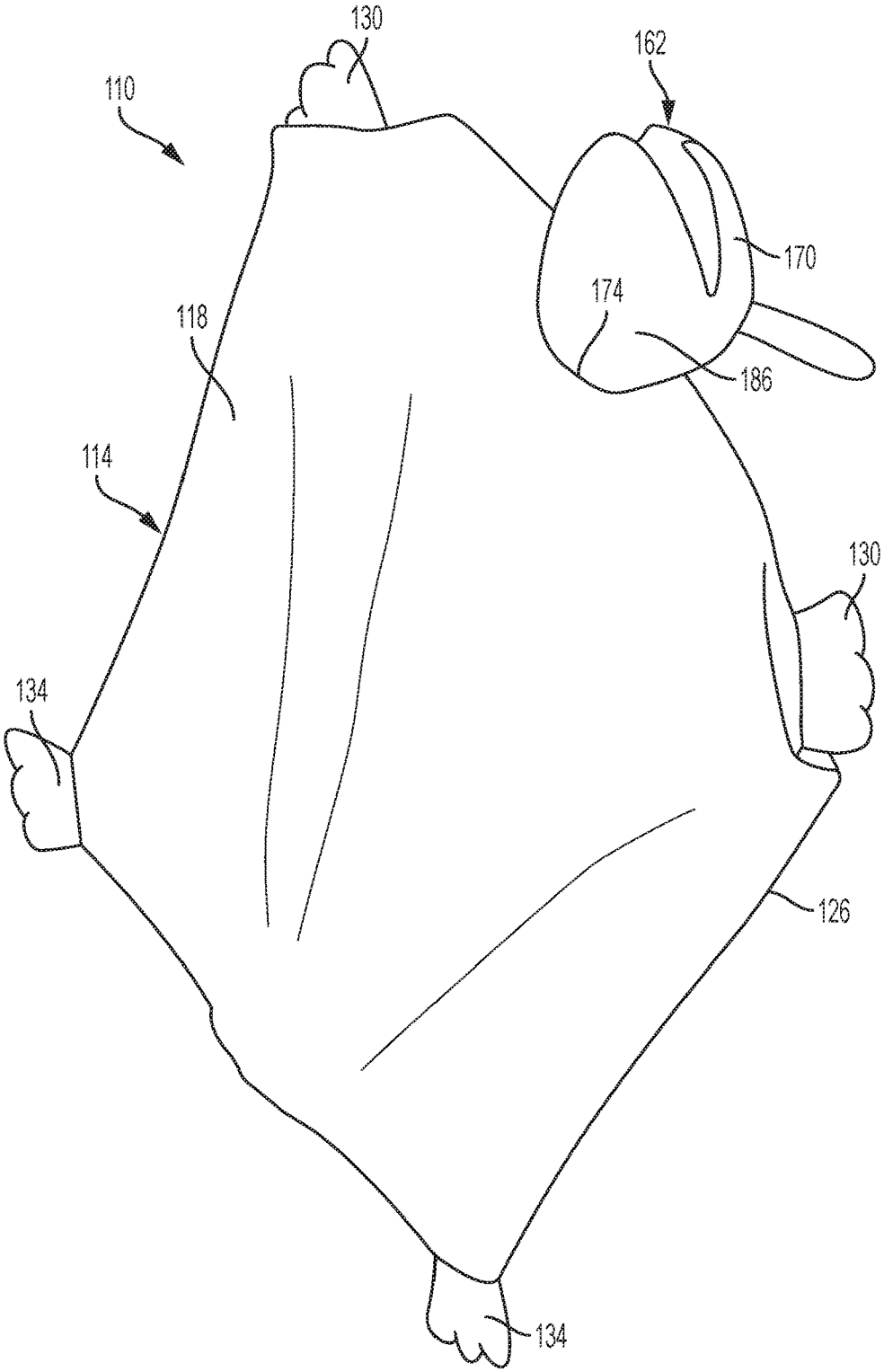
FIG. 15 is a perspective view of the toy of FIG. 10, illustrating the first side of the body representative of the first body appearance, and the head that is in the second configuration that corresponds to the second body appearance.
Figure 16:
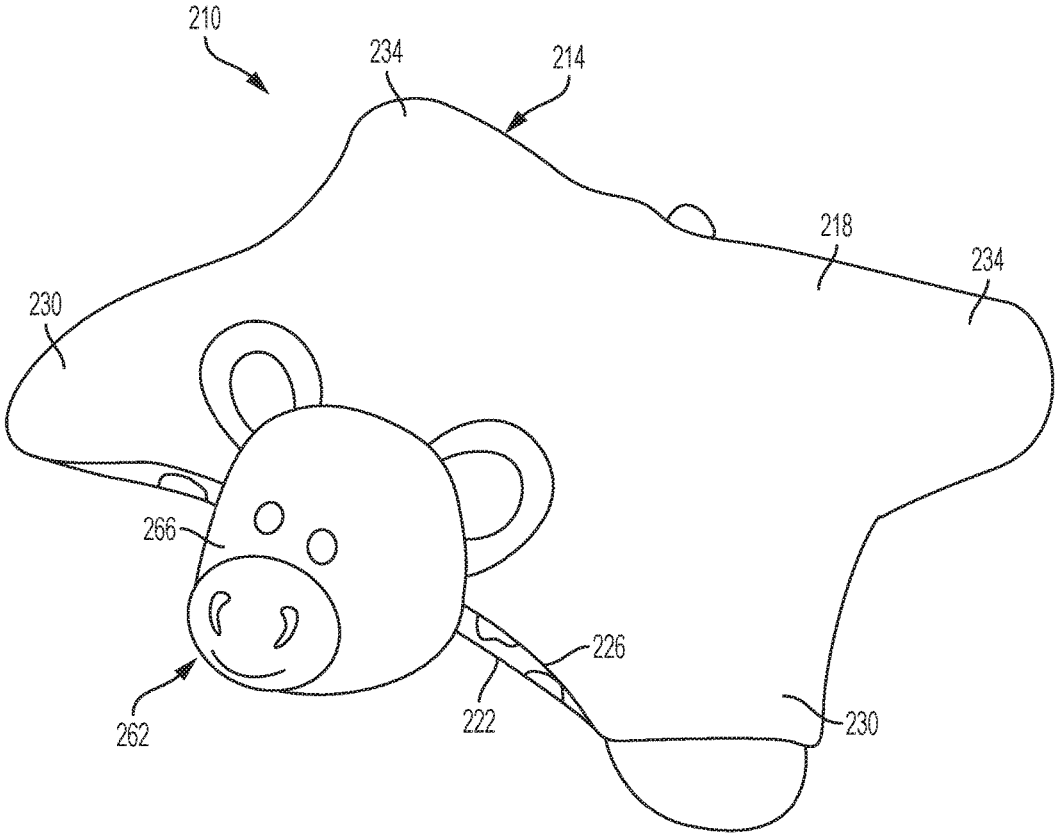
FIG. 16 is a perspective view of a toy according to another embodiment, illustrating a body having a first side representative of a first body appearance, and a head that is in a first configuration that corresponds to the first body appearance.
Figure 17:
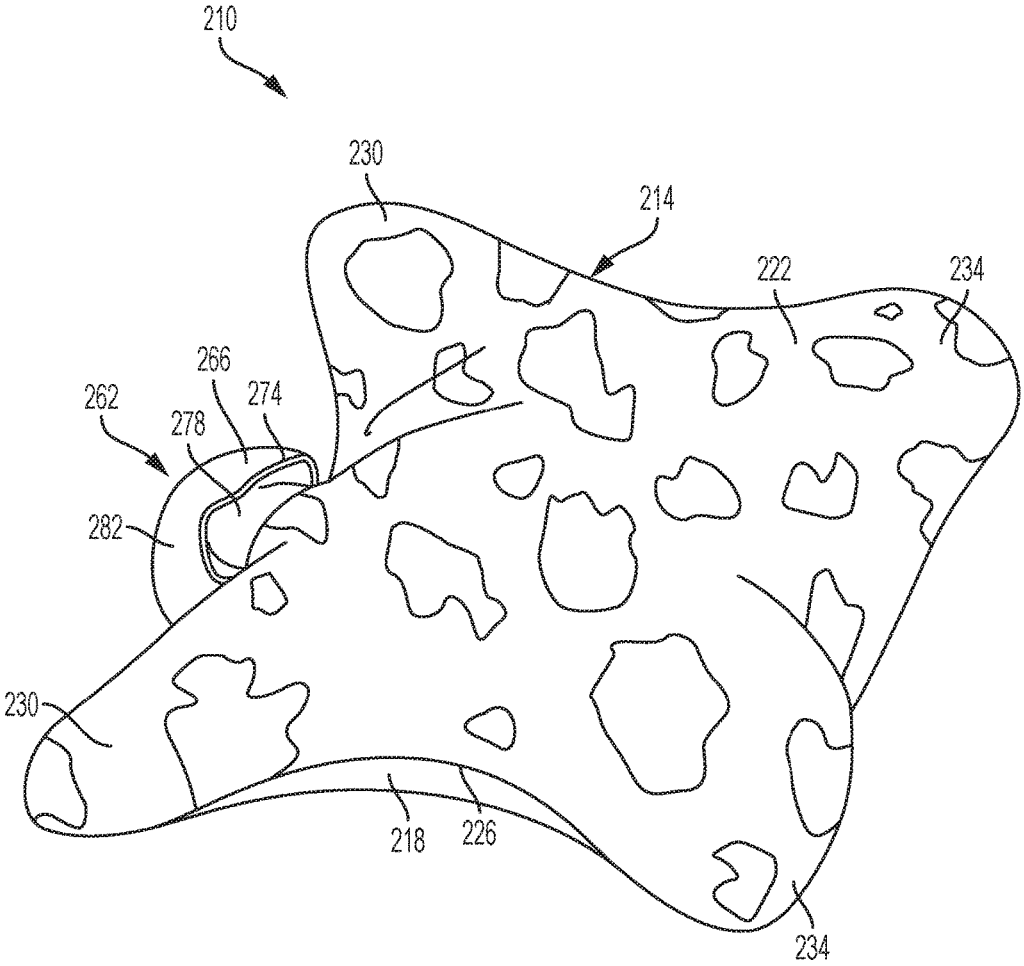
FIG. 17 is a perspective view of the toy of FIG. 16, illustrating a second side of the body representative of a second body appearance.
Figure 18:
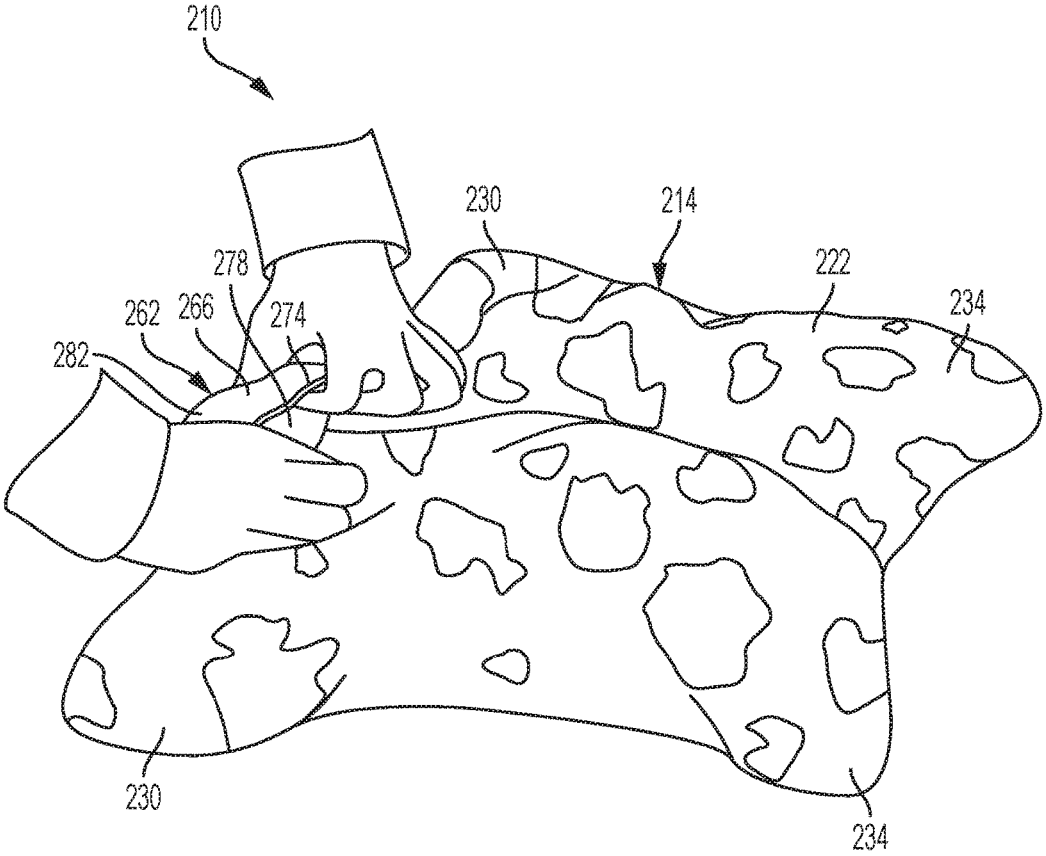
FIG. 18 is a perspective view of the toy of FIG. 16, illustrating a seam of the head that defines an opening in the head, and a user inserting her hand past the seam and into the opening.
Figure 19:
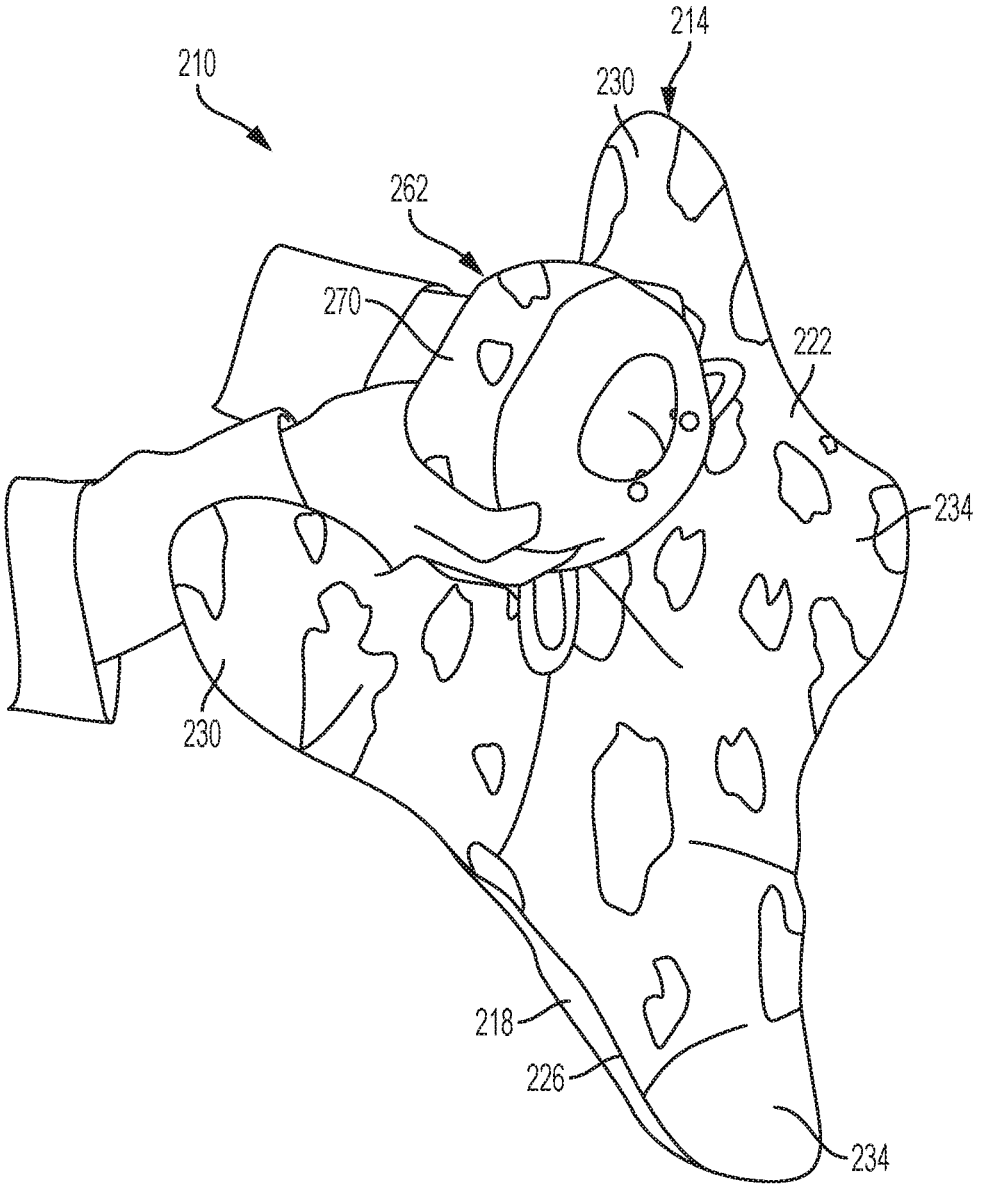
FIG. 19 is a perspective view of the toy of FIG. 16, illustrating the user reversing the head from the first configuration to a second configuration that corresponds to the second body appearance.
Figure 20:
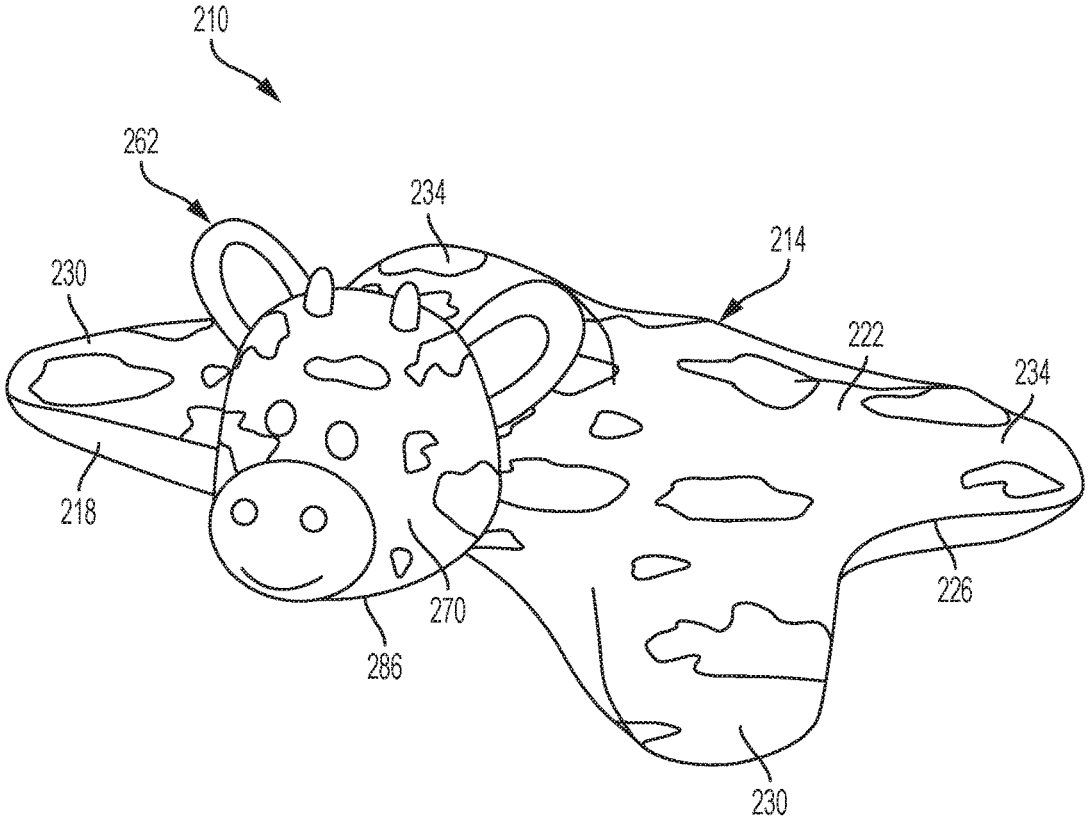
FIG. 20 is a perspective view of the toy of FIG. 16, after the head has been reversed to the second configuration.

FIGS. 12A-12G further illustrate a transformation of the head 162. In particular, FIG. 12A illustrates the head 162 in the first configuration, with the first face 166 and the first side 118 of the body 114 both visible, and the second face 170 concealed. FIG. 12B illustrates the toy 110 having been flipped over, such that the opening 178 is visible, and the second side 122 of the body 114 is visible. FIG. 12C illustrates a user inserting a hand into the opening 178. FIG. 12D illustrates the user grasping the second face 170 and pulling the second face 170 out through the opening 178. FIGS. 12E-12G illustrate the user completing the transformation from the first configuration of the head 162 to the second configuration of the head 162. As illustrated in FIG. 12G, the second face 170 is visible, and the first face 166 is concealed.

FIGS. 16-20 illustrate a toy 210 according to a third embodiment of the present invention. Similar to the toys 10, 110, the toy 210 is transformable to display a first image, design, character or object in a first state, and to display a second different image, design, character or object in a second state. The images or characters that may be displayed include, for example, commonly known movie or television characters, animated characters, animals, humans, inanimate objects, fantasy creatures or characters, historical characters, characters from books or other sources, or other articles, whether real or imagined. The materials used to form the toy 210 may be any suitable materials, including plush fabric, knit fabric, woven fabric, plastic, rubber, or any other suitable material for use as a toy.

The toy 210 includes a body 214 having a first side 218 representative of a first body appearance (i.e., a body of a pig in the illustrated embodiment), and a second opposite side 222 representative of a second body appearance (i.e., a body of a cow in the illustrated embodiment) that is different than the first body appearance. The body 214 includes a perimeter 226 (e.g., a single seam) that extends around an outer periphery of the body 214. The perimeter 226 separates the first side 218 of the body 214 from the second side 222 of the body 214. In the illustrated embodiment, the body 214 includes two front legs 230 and two rear legs 234, although other embodiments include different numbers of legs and/or arms, as well as different shapes and sizes for the body 214 than that illustrated. In some embodiments, the body 214 includes no arms or legs. As illustrated in FIGS. 16-20, the body 214 may be flipped over upside down (i.e., 180 degrees) such that either the first body appearance (i.e., the body of the panda) is visible, or the second body appearance (i.e., the body of the spotted dragon) is visible. The different body appearances can be created, for example, by using different colors, textures, patterns, materials, pile heights, appendages, and the like for the two sides 218, 222 of the body 214.

In contrast to the body 114 above, the body 214 is made of a plush material and filled with stuffing material (e.g., cotton, polyester, fiber, etc.) to form a three-dimensional structure, although other embodiments include bodies 214 that are generally flatter, thicker, or have shapes other than that illustrated, and/or are made of other materials or include different stuffing materials.

With continued reference to FIGS. 16-20, the toy 210 does not include a fastening arrangement. Thus, unlike the embodiment of FIGS. 1-9, the body 214 is not manipulated into a secured standing position in various states of the toy 210. Other embodiments, however, may include a fastening arrangement such as the fastening arrangement 38 described above or other fastening arrangements that might be used to gather or contain the blanket for display, transport, or storage.

With continued reference to FIGS. 16-20, the toy 210 further includes a head 262 coupled to the body 214 (e.g., stitched to the body 214 via a seam). The head 262 is reversible between a first configuration and a second configuration in a manner identical to that described above for the head 62. Thus, like parts have been given reference numerals increased by 200.

In some embodiments, the heads 62, 162, 262 described above do not represent the physical head of an animal or creature, but rather represent another portion of the animal or creature, or represent an image, design, or other object that is reversible between a first configuration and a second configuration. Additionally, while not illustrated, in some embodiments the toys 10, 110, 210 described above may include more than one reversible head 62, 162, 262.

Figure 21A:
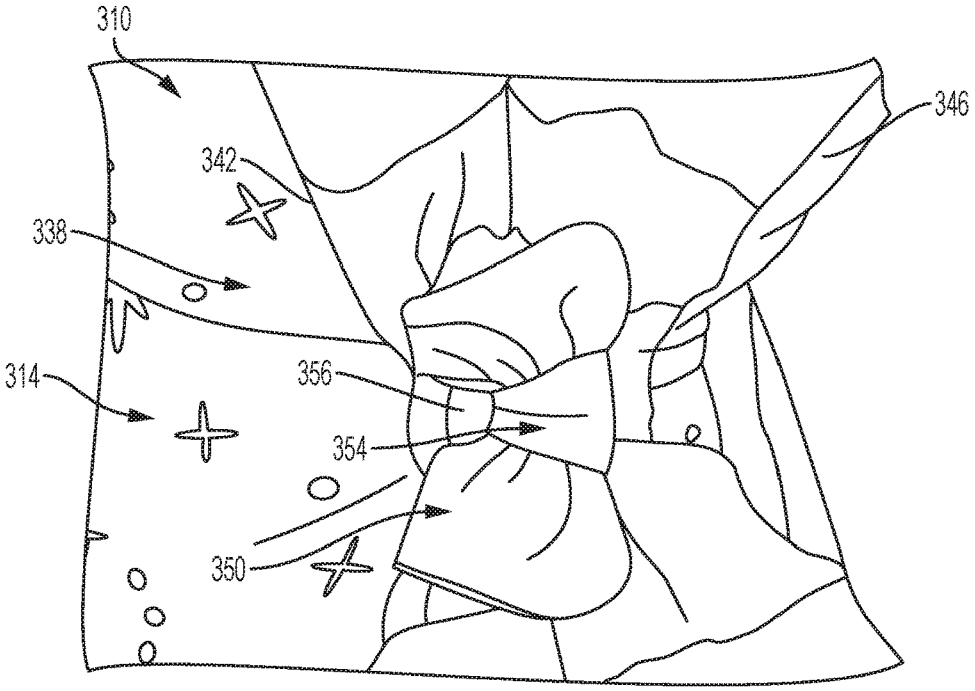
FIGS. 21A-E illustrate an alternative fastening arrangement for use with the toy.
Figure 21B:
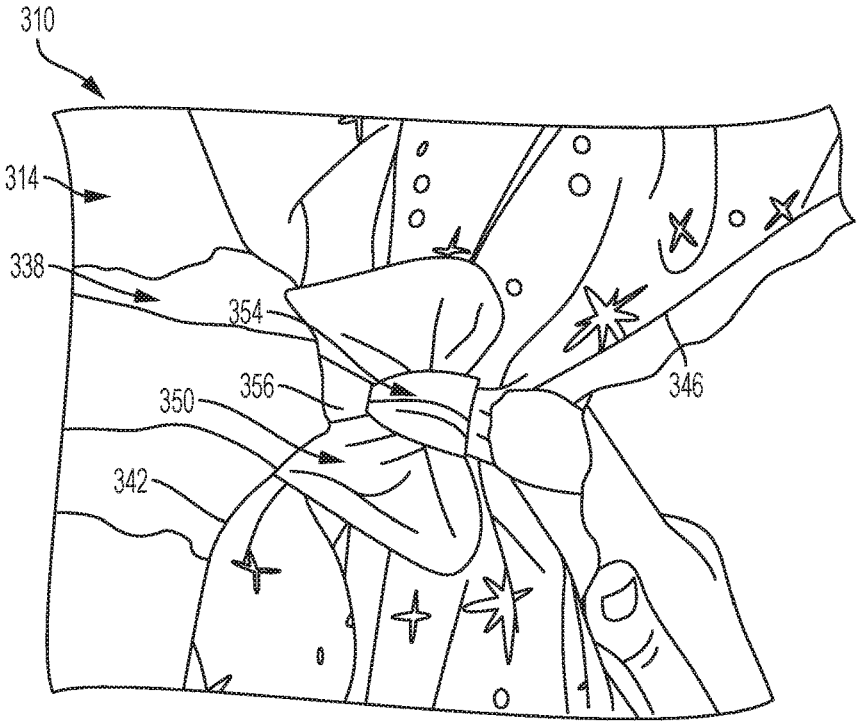
Figure 21C:
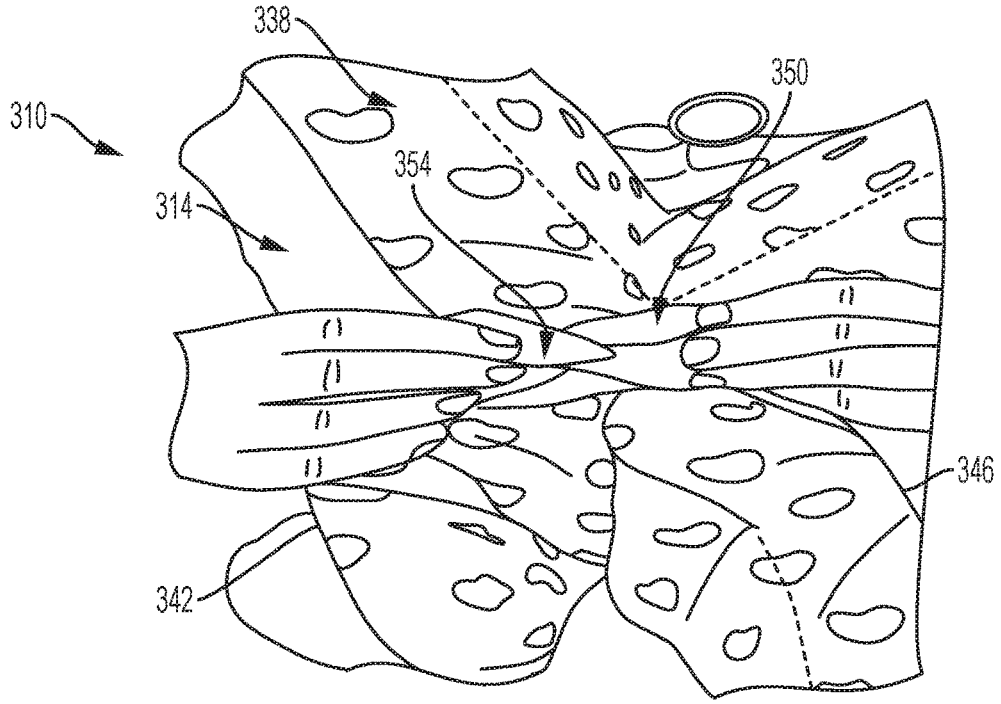
Figure 21D:
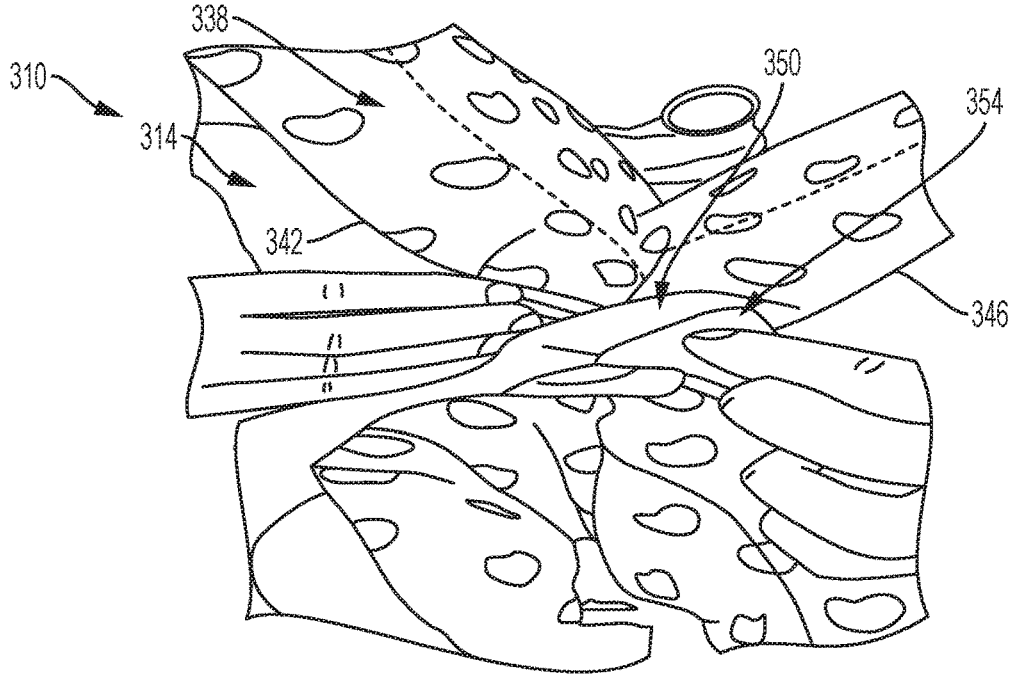
Figure 21E:
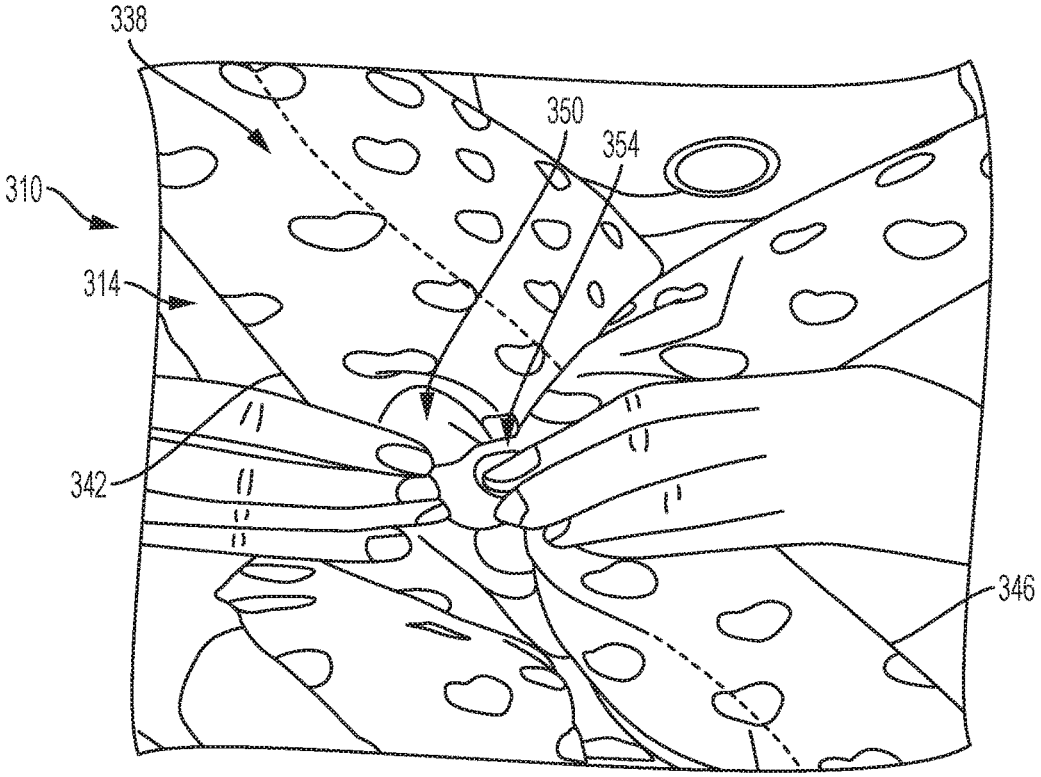

FIGS. 21A-E illustrate an alternative fastening arrangement 338 coupled to the body 314 (illustrated with different markings corresponding to different creatures in FIGS. 21A and 21B than in FIGS. 21C-E) and operable for drawing two opposite edges 342, 346 of the perimeter 326 toward each other (i.e., to fold the toy 310). In the illustrated embodiment, the fastening arrangement 338 includes a first strap 350 coupled (e.g., stitched via a seam) to the first edge 342, and a second strap 354 coupled (e.g., stitched via a seam) to the second edge 346. The first strap 350 is coupled to the body 314 at two spaced apart locations so as to define a loop with an opening 356 through which the second strap 354 can pass. The second strap 354 includes hook and loop fasteners (e.g., Velcro®) coupled to a distal end of the second strap 354 on oppositely facing sides of the second strap 354 such that the second strap 354 can be inserted into the opening 356 defined by the loop of the first strap 350 and then secured to itself (i.e., to the second strap 354) using the hook and loop fastener arrangement. In some embodiments, the distal end of the second strap 354 is sandwiched between one side of the first strap 350 and the remainder of the second strap 354 after attachment. Other embodiments might use snaps, buttons, hooks, or other similar fasteners, or other locations for fasteners on the first and/or second strap 350, 354. The first and second straps 350, 354 are shaped such that when they are coupled together as described above, the two straps 350, 354 together provide the appearance of a bow as the fastening arrangement 338. The strap 350 forms the two sides of the bow with the strap 354 forming the center member of the bow. The oppositely facing sides of the straps 350, 354 can be coordinated in color, pattern, texture, material, pile height, etc. in order to correspond to the body appearance that they operate to secure in the exposed or outwardly-facing orientation.

In some embodiments, the toys 10, 110, 210, 310 are sold to stores and/or consumers with only one of the images, designs, characters or objects being known (e.g., only one being visible in the packaging), but not the other image, design, character or object. Thus, purchase of one of the toys 10, 110, 210, 310 includes an element of surprise for the store owner or consumer, since the store owner or consumer will not know what the first image, design, character or object will transform into when the head 62, 162, 262 is reversed and the toy 10 is converted between the different states.

FIGS. 22-32 illustrate a toy 410 of yet another embodiment of the present invention. The construction and operation of the toy 410 is similar to the toys 10, 210, 310 described above, such that only the differences and additions will be described in detail. Like parts have been given like reference numbers of the 400 series.

Figure 22:
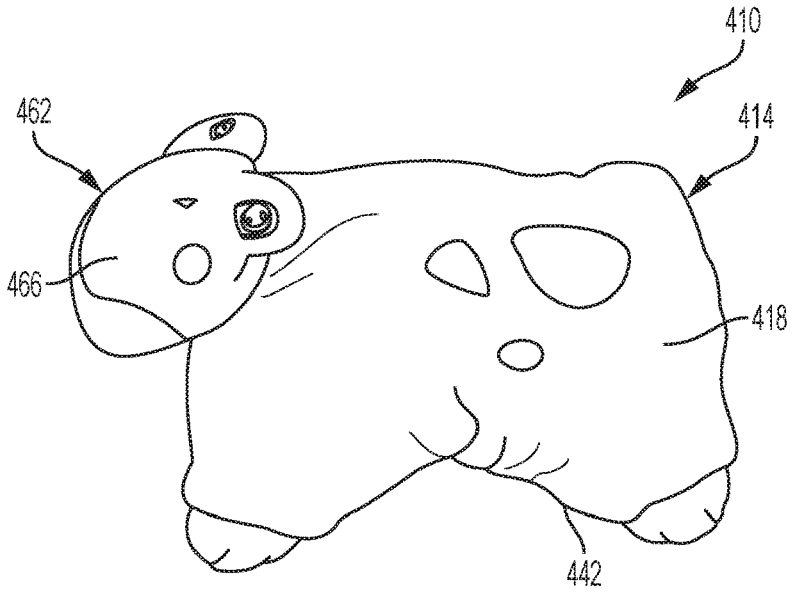
FIG. 22 is a perspective view of a toy according to another embodiment, shown in a first configuration.
Figure 23:
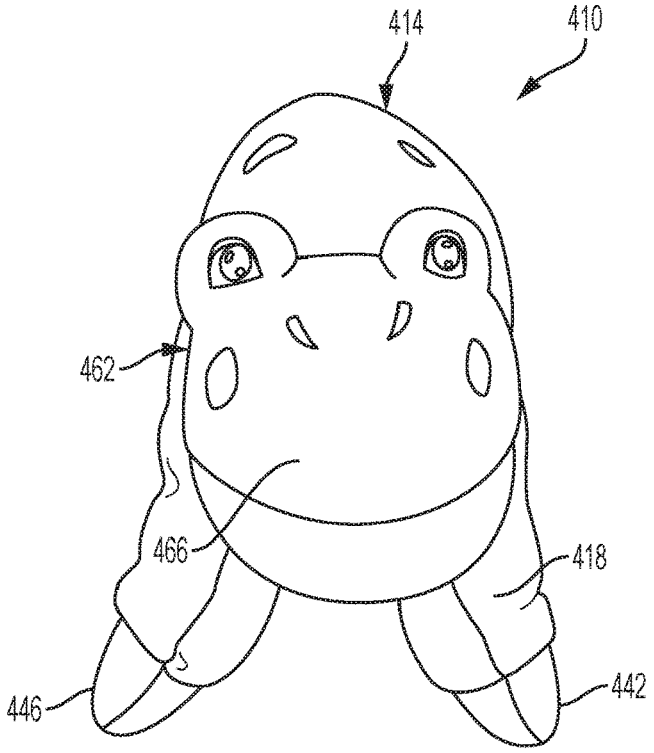
FIG. 23 is a front view of the toy of FIG. 22.
Figure 24:
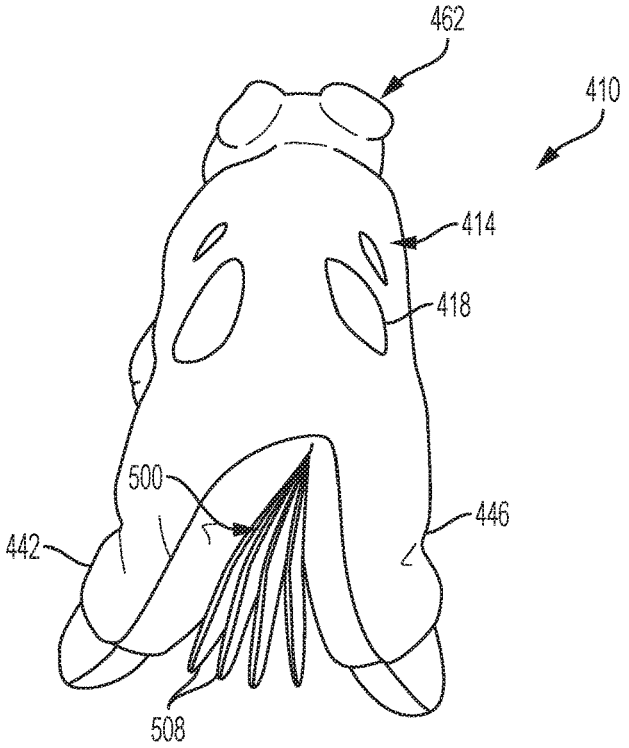
FIG. 24 is a rear view of the toy of FIG. 22.

With reference to FIGS. 22-24, the toy 410 may initially be in a first state where the first side 418 of the body 414 representative of the first body appearance (i.e., corresponding to the body of a frog) is visible and generally externally-facing, and where the head 462 is in the first configuration (i.e., corresponding to the head of the frog) with the first face 466 fully visible. The body 414 is folded so that the first side 418 defines an exterior of the toy 410 and the second side 422 (see FIGS. 25-32) defines an interior of the 410 toy. In this first state, the fastening arrangement 438 (see FIG. 25) is connected, such that the opposite edges 442, 446 of the body 414 are pulled together, and the toy 410 can stand upright as a first character (i.e., a standing frog).

Figure 25:
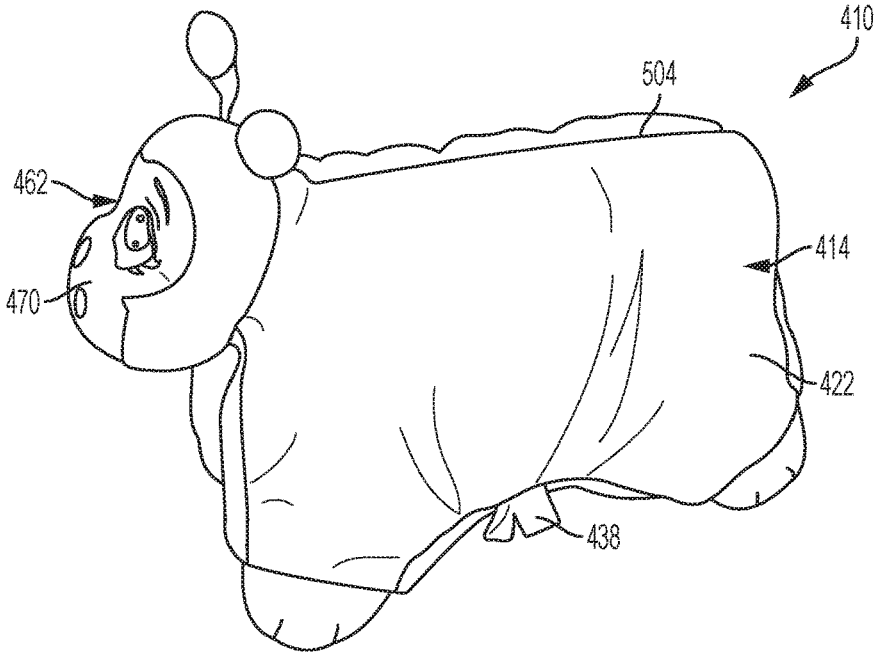
FIG. 25 is a perspective view of the toy of FIG. 22, shown in a second configuration.
Figure 26:
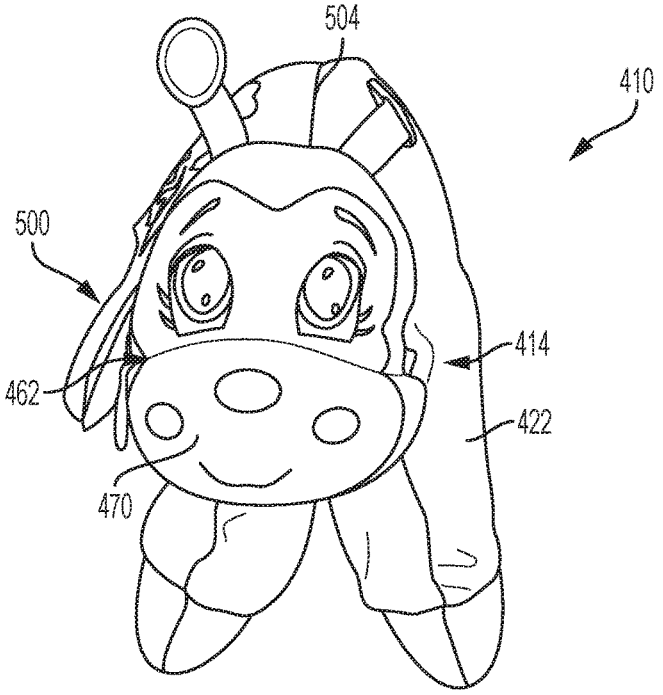
FIG. 26 is a front view of the toy of FIG. 25.
Figure 27:
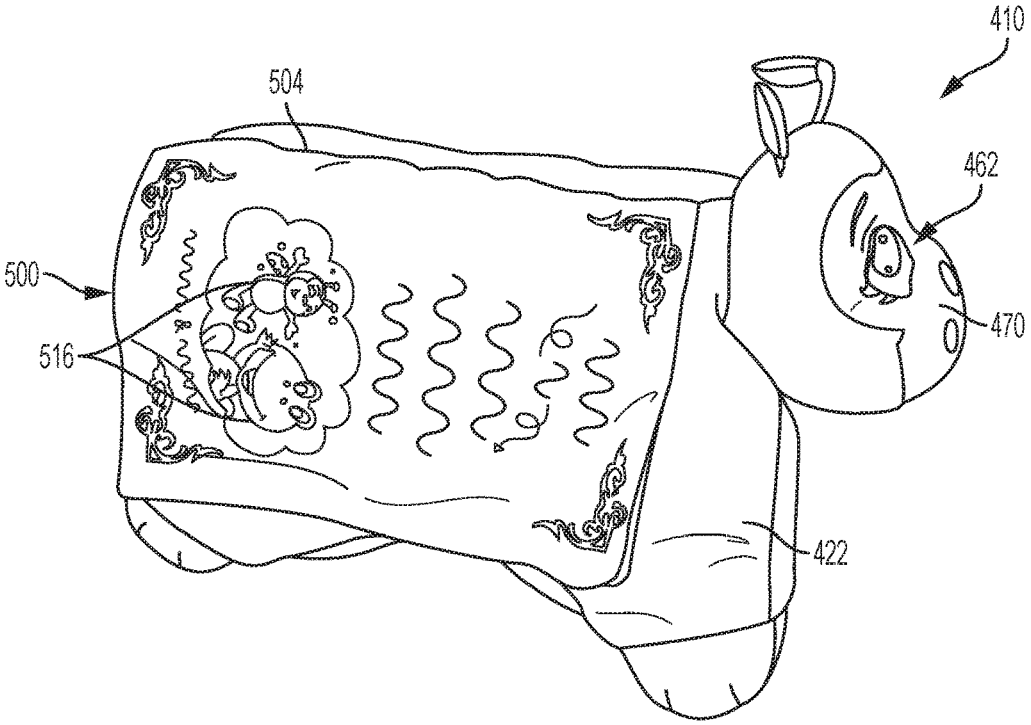
FIG. 27 is another perspective view of the toy of FIG. 25.

FIGS. 25-27 illustrate the toy 410 in a second state where the second side 422 of the body 414, representative of the second body appearance (i.e., corresponding to the body of a ladybug), and the second face 470 of the head 462 (i.e., corresponding to the head of the ladybug) are both visible and generally externally-facing with the toy 410 standing upright as a second character (i.e., a standing ladybug). The body 414 is folded so that the second side 422 defines an exterior of the toy 410 and the first side 418 defines an interior of the 410 toy. Transformation of the toy 410 between the first and second states takes place in the same manner described in detail above.

Figure 32:
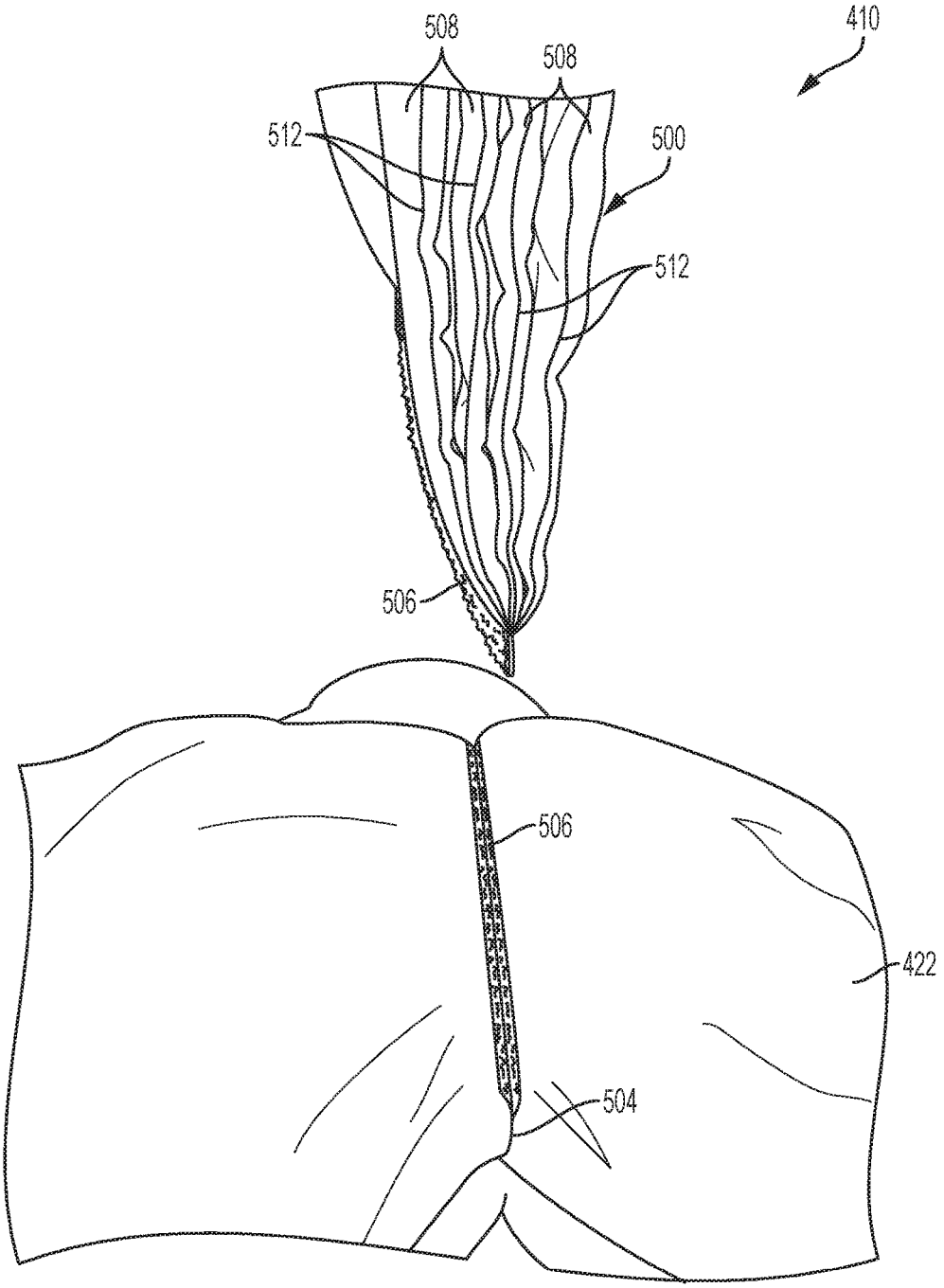
FIG. 32 is an enlarged partial view of the toy of FIG. 25 illustrating an alternative embodiment in which the book can be removably coupled to the body of the toy.

Referring now to FIGS. 26-32, the toy 410 differs from the toys 10, 210, and 310 in that it further includes a book 500 coupled to the second side 422 of the body 414. It is to be understood that the book 500 could alternatively be coupled to the first side 418 of the body 414. In the illustrated embodiment, the book 500 is permanently attached to the second side 422 of the body 414 by being stitched to the second side 422 of the body 414 along a seam 504. The seam 504 is centrally positioned with respect to the body 414 such that it is located in the vicinity of what would be the spine of the standing creature in the second state (see FIGS. 25-27). In other embodiments, the book 500 could be permanently attached to the body 414 in other manners and in other locations. In yet other embodiments, the book 500 could be removably coupled to the body 414 such that the book 500 could be detached from the second side 422 and perhaps even removably attached to the first side 418 (e.g., by using hook-and-loop fasteners, ties, or other removable fastening methods 506). FIG. 32 illustrates such an embodiment with a removable book 500.

In the illustrated embodiment, the book 500 includes a plurality of leaves 508 (e.g., 4 leaves are illustrated—see FIGS. 28-32) made from fabric. Each leaf 508 has oppositely-facing sides defining pages (e.g., cover pages or interior pages) of the book 500. The number of leaves 508 (and therefore pages) can vary as desired. The construction of the book 500 and its leaves 508 can also vary, however in the illustrated embodiments, each leaf 508 is formed from two sheets of fabric stitched together along a peripheral seam 512 (see FIG. 31). Thus, for a given leaf 508, each oppositely-facing page is a different sheet of fabric. The four leaves 508 of the illustrated book 500 can be made by first stitching together two rectangular sheets of fabric that will eventually form the first and last leaves 508 of the book 500 (including the front and back cover pages, the page inside the front cover, and the page inside the back cover), and then stitching together two additional rectangular sheets of fabric that will eventually form the second and third leaves 508 of the book 500 (including the remaining interior pages). Next, the two rectangular leaf assemblies can be stacked on one another and stitched through the center of both rectangular leaf assemblies and along the seam 504 to create the spine of the book and to divide the two leaf assemblies into the four individual leaves 508, thereby coupling the leaves 508 to the second side 422 as shown. Of course, in other embodiments, the four leaves 508 could each be independently constructed and connected together along the seam 504.

The fabric chosen for the book 500 can vary based on the desired softness, rigidity, and color/texture of the leaves 508. In the illustrated embodiment, the fabric is a soft fabric with low rigidity, such that the book 500 is generally as soft as the remainder of the plush toy 410. This enables the toy 410 to be played with and used as a soft pillow, even with the addition of the book 500. In the illustrated embodiment, a white fabric is used for the leaves 508 and is screen-printed or otherwise marked to provide a story on the pages of the book 500.

In the illustrated embodiment, the story provided in the book 500 relates directly to the two creatures or characters depicted by the body appearances and the head configurations of the toy 410. In other words, the book tells a story about the two creatures or characters depicted by the toy 410. Specifically, for the illustrated embodiment in which the toy 410 is reversible or reconfigurable between a frog and a ladybug, the book 500 tells a story of a frog (i.e., a first character corresponding to the first body appearance and the first face of the toy 410) and a ladybug (i.e., a second character corresponding to the second body appearance and the second face of the toy 410). The story includes indicia 516 representative of the first and second characters, and can describe a relationship, scenario, activity, or the like involving the first and second characters. In one exemplary story, the indicia 516 take the form of images, pictures, or other likenesses of the first and second characters (i.e., a frog and a ladybug). Text describes a relationship in which the first and second characters are friends, and the story can inspire a child to play with the toy 410 and reverse or "flip" the toy 410 between its two different creatures or characters.

Figure 28:
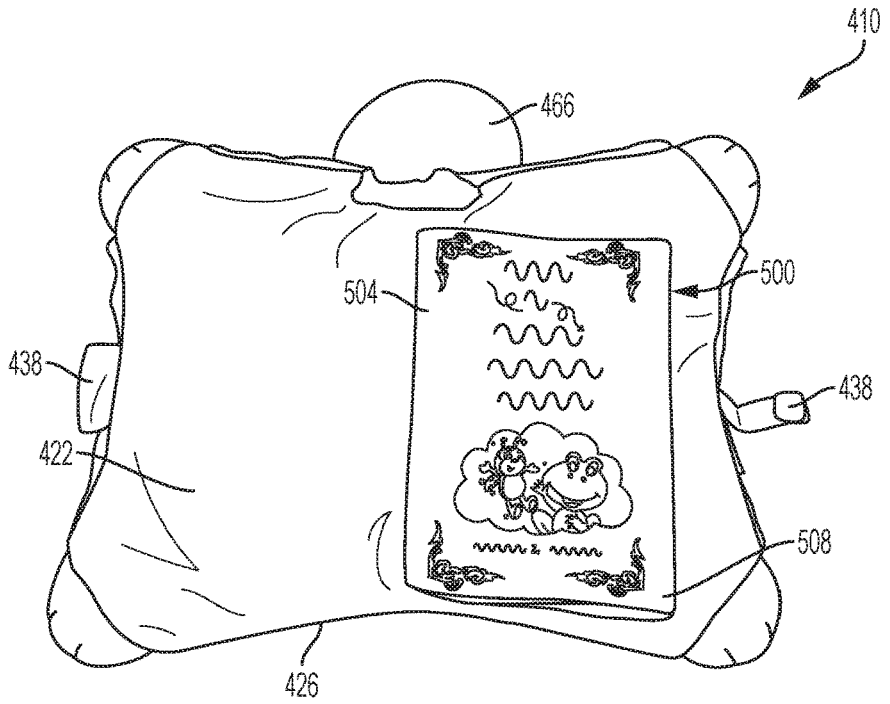
FIGS. 28-30 illustrate the toy of FIG. 22 shown in an unfolded position with a book fully exposed to view.
Figure 29:
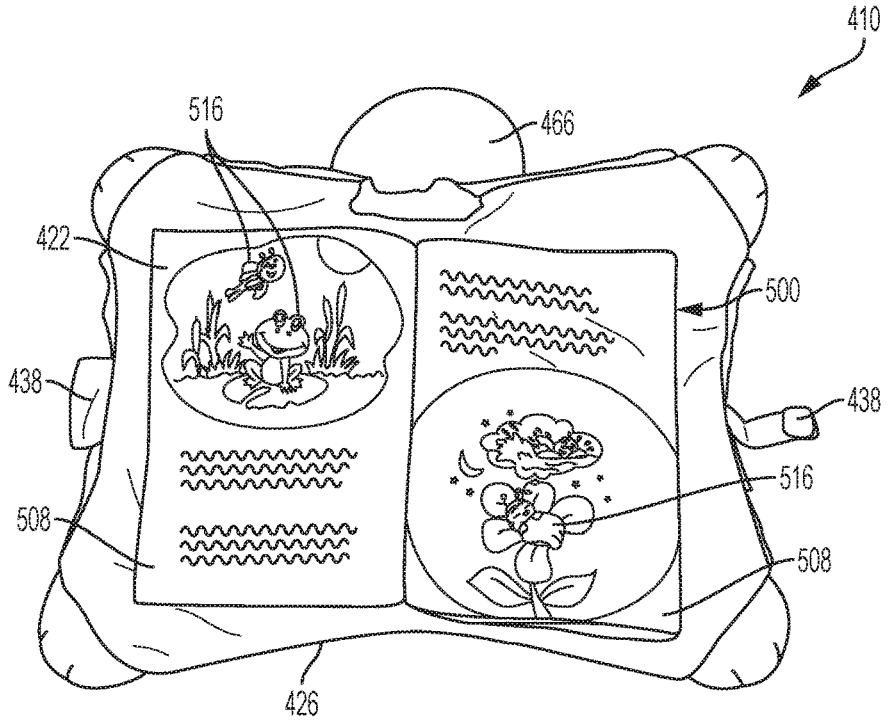
Figure 30:
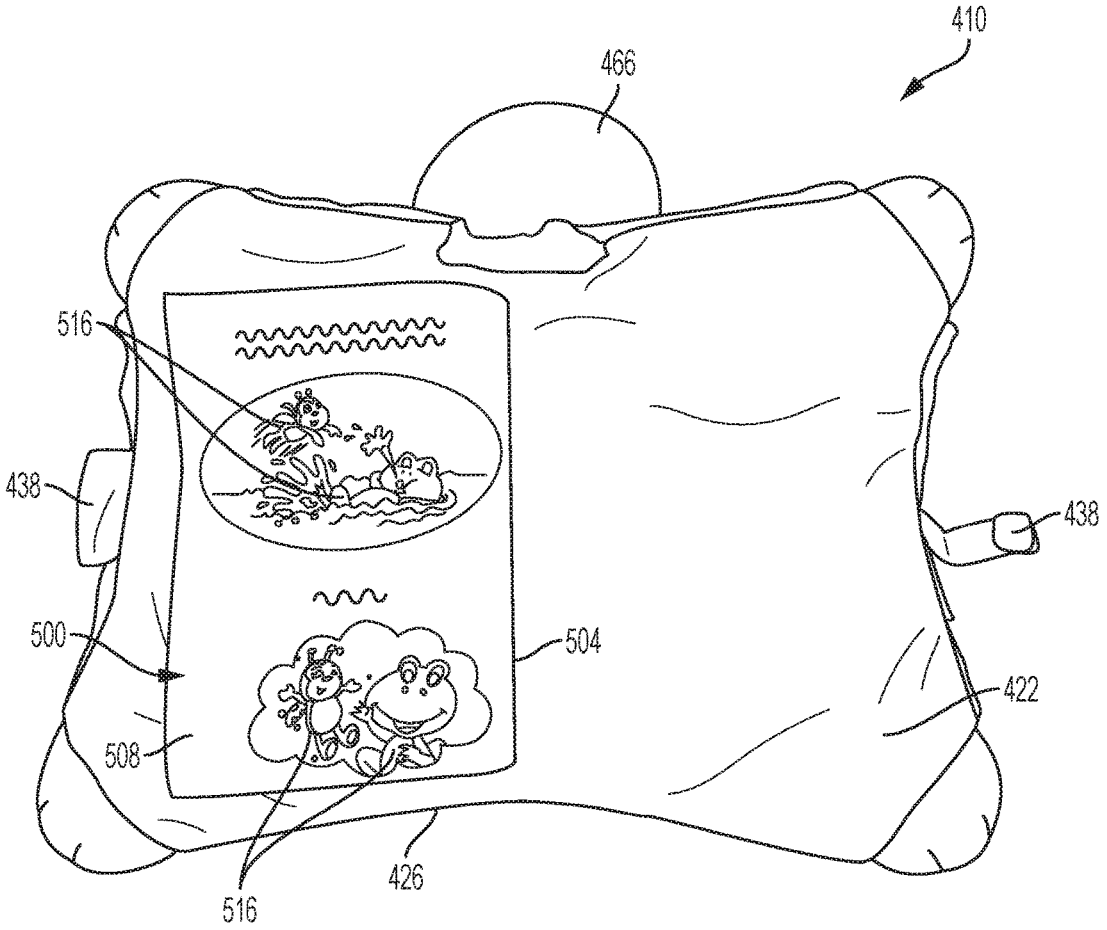
Figure 31:
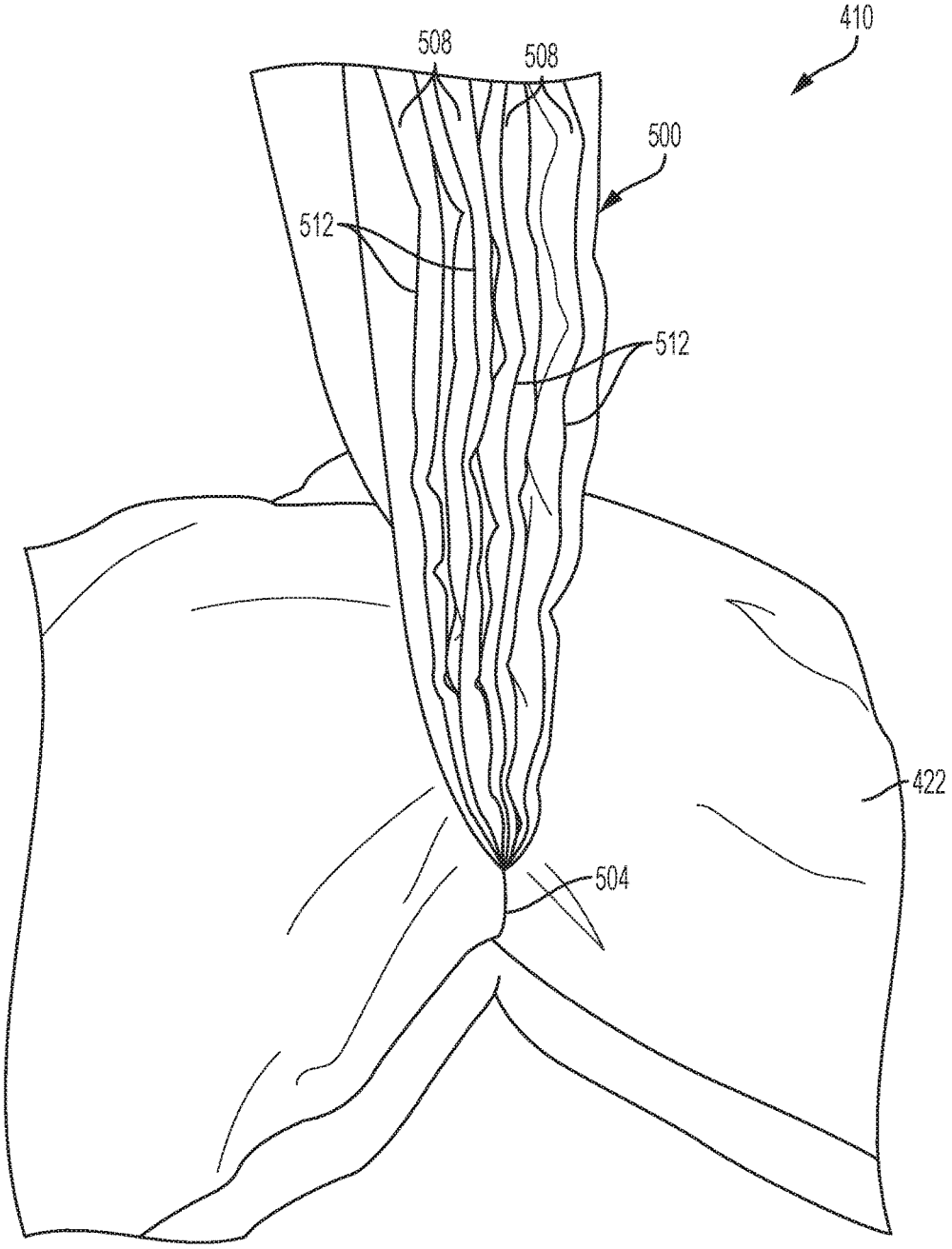
FIG. 31 is an enlarged partial view of the toy of FIG. 25 illustrating the construction of the book.

As best shown in FIGS. 28-30, the illustrated book 500 is coupled to the second surface 422 such that the book 500 is entirely positioned within the perimeter 426 defining the outer periphery of the body 414. In this manner, the leaves 508 of the book 500 will be supported by the second surface 422 and fully exposed to view when the toy 410 is positioned in the unfolded configuration shown in FIGS. 28-30. Additionally, when the toy 410 is folded into the first state or configuration shown in FIGS. 22-24, and the fastening arrangement 438 secures the two edges 442, 446 together, the book 500 is at least partially hidden from view. As shown in FIG. 22, the book 500 is hidden from view when viewing the toy 410 from above and/or from the sides. As shown in FIG. 23, the book is at least partially hidden from view (depending on the viewing angle) when viewing the toy 410 from the front. As shown in FIG. 24, only the ends of the leaves 508 can be seen when viewing the toy 410 from the rear. The toy 410 can be packaged in this first configuration for transport and/or retail sale to protect the book 500 from damage. In some embodiments, the packaging could include a cardboard sleeve placed around the central portion of the body 414. The sleeve could include a carrying handle, product information, etc.

Although the invention has been described in detail with reference to certain preferred embodiments, variations and modifications exist within the scope and spirit of one or more independent aspects of the invention as described.

Various features and advantages of the invention are set forth in the following claims.

The invention claimed is:

1. A toy comprising:

a body having a first side representative of a first body appearance and a second side opposite the first side and representative of a second body appearance different from the first body appearance, wherein the body has a perimeter with two opposite edges;

a head coupled to the body, the head being reversible between a first face and a second face, the first face corresponding to the first body appearance and the second face corresponding to the second body appearance, wherein the toy has a first configuration in which the first body appearance and first face are exposed to view and the second face is concealed from view, and a second configuration in which the second body appearance and the second face are exposed to view and the first face is concealed from view;

a fastening arrangement coupled to the body and operable for drawing the two opposite edges of the perimeter toward each other, wherein the first configuration and the second configuration of the toy each has a first state and a second state, wherein in the first state the fastening arrangement is connected and the two opposite edges of the perimeter are drawn together such that the body is folded along a centerline of the body, and wherein in the second state the fastening arrangement is disconnected and the two opposite edges of the perimeter can be spread apart such that the body is configured to lay flat;

wherein when the first face of the head is exposed to view, the second face of the head is concealed from view inside the head, and wherein when the second face of the head is exposed to view, the first face of the head is concealed from view inside the head; and a book coupled to the second side of the body so that in the first configuration and the first state, the book is at least partially concealed from view, and in the second configuration and the first state, the book is exposed to view.

2. The toy of claim 1, wherein the book is permanently attached to the second side of the body.

3. The toy of claim 1, wherein the book is removably coupled to the second side of the body.

4. The toy of claim 1, wherein the book is entirely within the perimeter.

5. The toy of claim 1, wherein the book includes a plurality of leaves made from fabric.

6. The toy of claim 5, wherein each leaf is formed from two sheets of fabric stitched together.

7. The toy of claim 1, wherein the book includes indicia conveying a story about a first character and a second character, the first character corresponding to the first body appearance and the first face, and the second character corresponding to the second body appearance and the second face.

8. The toy of claim 7, wherein the indicia includes images of the first and second characters.

9. A toy comprising:

a body having a first side and a second side opposite the first side, wherein the body has a perimeter with two opposite edges;

a head coupled to the body, wherein the head includes first and second faces joined together to form a reversible pouch having an opening; and a fastener coupled to the body and configured to secure the two opposite edges of the perimeter together, wherein the toy has a first configuration with a first state and a second state, wherein in the first state of the first configuration the fastener is connected to secure the two opposite edges of the perimeter together such that the body is folded along a centerline of the body with the first side defining an exterior of the toy and the second side defining an interior of the toy, and wherein in the second state of the first configuration the fastener is disconnected and the two opposite edges of the perimeter can be spread apart such that the body is configured to lay flat;

wherein the toy has a second configuration with a first state and a second state, wherein in the first state of the second configuration the fastener is connected to secure the two opposite edges of the perimeter together such that the body is folded along a centerline of the body with the second side defining an exterior of the toy and the first side defining an interior of the toy, and wherein in the second state of the second configuration the fastener is disconnected and the two opposite edges of the perimeter can be spread apart such that the body is configured to lay flat;

and wherein the toy further comprises a book coupled to the second side, the book being at least partially hidden from view when the toy is in the first state of the first configuration, and the book being exposed to view when the toy is in the first state of the second configuration.

10. The toy of claim 9, wherein the book is permanently attached to the second side of the body.

11. The toy of claim 9, wherein the book is removably coupled to the second side of the body.

12. The toy of claim 9, wherein the book is entirely within the perimeter.

13. The toy of claim 9, wherein the book includes a plurality of leaves made from fabric.

14. The toy of claim 13, wherein each leaf is formed from two sheets of fabric stitched together.

15. The toy of claim 9, wherein the head includes first and second faces, the first face corresponding to an appearance of the first side of the body and the second face corresponding to an appearance of the second side of the body, and wherein the book includes indicia conveying a story about a first character and a second character, the first character corresponding to the appearance of the first side of the body and the first face, and the second character corresponding to the appearance of the second side of the body and the second face.

16. The toy of claim 15, wherein the indicia includes images of the first and second characters.

17. The toy of claim 9, wherein the pouch is reversible from a first configuration to a second configuration by pulling the second face out of the pouch through the opening, and wherein the pouch is reversible from the second configuration to the first configuration by pulling the first face out of the pouch through the opening.

* * * * *